US012617015B2

(12) United States Patent
Zhan et al.

(10) Patent No.: US 12,617,015 B2
(45) Date of Patent: May 5, 2026

(54) PRODUCING HYDRO-EFFLUX HAMMER USING CATALYST-FREE PDC CUTTERS

(71) Applicant: Saudi Arabian Oil Company, Dhahran (SA)

(72) Inventors: Guodong Zhan, Dhahran (SA); Jianhui Xu, Dhahran (SA); Bodong Li, Dhahran (SA); Abdulwahab S. Aljohar, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 455 days.

(21) Appl. No.: 18/169,688

(22) Filed: Feb. 15, 2023

(65) Prior Publication Data

US 2023/0201921 A1 Jun. 29, 2023

Related U.S. Application Data

(63) Continuation-in-part of application No. 17/336,637, filed on Jun. 2, 2021, now Pat. No. 12,042,868.

(Continued)

(51) Int. Cl.

| | |
|---|---|
| ***E21B 1/38*** | (2006.01) |
| ***B22F 3/14*** | (2006.01) |
| ***B22F 3/16*** | (2006.01) |
| ***B22F 5/00*** | (2006.01) |
| ***B22F 7/06*** | (2006.01) |

(Continued)

(52) U.S. Cl.

CPC ..... *B22F 3/14* (2013.01); *B22F 3/16* (2013.01); *B22F 7/06* (2013.01); *E21B 1/38* (2020.05); *E21B 10/40* (2013.01); *E21B 10/55* (2013.01); *E21B 10/5673* (2013.01); *B22F 2005/001* (2013.01); *B22F 2302/10* (2013.01); *B22F 2302/406* (2013.01); *B22F 2998/10* (2013.01)

(58) Field of Classification Search

CPC .. E21B 1/38; E21B 10/5673; E21B 10/56735; C22C 26/00; B22F 7/06; B22F 2005/001

See application file for complete search history.

(56) References Cited

U.S. PATENT DOCUMENTS

| | | | |
|---|---|---|---|
| 3,632,369 | A | 1/1972 | Hahn et al. |
| 4,017,480 | A | 4/1977 | Baum |

(Continued)

FOREIGN PATENT DOCUMENTS

| | | |
|---|---|---|
| AU | 2005286168 | 3/2006 |
| CN | 104499936 | 4/2015 |

(Continued)

OTHER PUBLICATIONS

CN Office Action in Chinese Appln. No. 202180038314.9, dated Jul. 18, 2023, 24 pages, with English Translation.

(Continued)

*Primary Examiner* — Sally A Merkling
*Assistant Examiner* — Sean P. O'Keefe
(74) *Attorney, Agent, or Firm* — Fish & Richardson P.C.

(57) ABSTRACT

Cutters for a downhole drill bit can be formed by providing a catalyst-free synthesized polycrystalline diamond (PCD) having a cross-sectional dimension of at least 8 millimeters; providing a substrate comprising tungsten carbide; and attaching the synthesized PCD to the substrate comprising tungsten carbide to form a PDC cutter.

9 Claims, 16 Drawing Sheets

Related U.S. Application Data

(60) Provisional application No. 63/033,669, filed on Jun. 2, 2020.

(51) Int. Cl.
*E21B 10/40* (2006.01)
*E21B 10/55* (2006.01)
*E21B 10/567* (2006.01)

(56) References Cited

U.S. PATENT DOCUMENTS

| | | | |
|---|---|---|---|
| 4,129,437 | A | 12/1978 | Taguchi et al. |
| 4,181,752 | A | 1/1980 | Martens et al. |
| 4,255,165 | A | 3/1981 | Dennis et al. |
| 4,288,248 | A | 9/1981 | Bovenkerk et al. |
| 4,334,928 | A | 6/1982 | Hara |
| 4,343,651 | A | 8/1982 | Yazu et al. |
| 4,394,170 | A | 7/1983 | Sawaoka et al. |
| 4,525,178 | A | 6/1985 | Hall |
| 4,664,705 | A | 5/1987 | Horton et al. |
| 4,859,531 | A | 8/1989 | Tsuji et al. |
| 4,943,488 | A | 7/1990 | Sung et al. |
| 4,945,073 | A | 7/1990 | Dubensky et al. |
| 5,000,273 | A | 3/1991 | Horton et al. |
| 5,030,276 | A | 7/1991 | Sung et al. |
| 5,037,704 | A | 8/1991 | Nakai et al. |
| 5,096,465 | A | 3/1992 | Chen et al. |
| 5,199,832 | A | 4/1993 | Meskin et al. |
| 5,326,380 | A | 7/1994 | Yao et al. |
| 5,337,844 | A | 8/1994 | Tibbitts |
| 5,370,195 | A | 12/1994 | Keshavan et al. |
| 5,387,776 | A | 2/1995 | Preiser |
| 5,523,158 | A | 6/1996 | Kapoor et al. |
| 5,603,070 | A | 2/1997 | Cerutti et al. |
| 5,833,021 | A | 11/1998 | Mensa-Wilmot et al. |
| 5,848,348 | A | 12/1998 | Dennis |
| 5,889,219 | A | 3/1999 | Moriguchi et al. |
| 6,008,153 | A | 12/1999 | Kukino et al. |
| 6,073,518 | A | 6/2000 | Chow et al. |
| 6,096,436 | A | 8/2000 | Inspektor |
| 6,209,420 | B1 | 4/2001 | Butcher et al. |
| 6,453,899 | B1 | 9/2002 | Tselesin |
| 6,469,278 | B1 | 10/2002 | Boyce |
| 6,623,850 | B2 | 9/2003 | Kukino et al. |
| 7,322,776 | B2 | 1/2008 | Webb et al. |
| 7,441,610 | B2 | 10/2008 | Belnap et al. |
| 7,645,513 | B2 | 1/2010 | Bello et al. |
| 7,647,992 | B2 | 1/2010 | Fang et al. |
| 8,071,173 | B1 | 12/2011 | Sani |
| 8,130,903 | B2 | 3/2012 | Corbett et al. |
| 8,512,865 | B2 | 8/2013 | DiGiovanni |
| 8,734,552 | B1 | 5/2014 | Vail et al. |
| 8,931,582 | B2 | 1/2015 | Cooley et al. |
| 8,960,337 | B2 | 2/2015 | Hall et al. |
| 9,097,074 | B2 | 8/2015 | Shen et al. |
| 9,254,554 | B1 | 2/2016 | Bertagnolli |
| 9,435,159 | B2 | 9/2016 | Scott |
| 9,482,056 | B2 | 11/2016 | Eyre et al. |
| 9,683,410 | B2 | 6/2017 | Zhang et al. |
| 10,000,970 | B2 | 6/2018 | Tulloch et al. |
| 10,017,998 | B2 | 7/2018 | Bilen et al. |
| 10,118,223 | B2 | 11/2018 | Eason |
| 10,179,390 | B2 | 1/2019 | Mukhopadhyay et al. |
| 10,612,311 | B2 | 4/2020 | Duerholt |
| 10,682,238 | B2 | 6/2020 | Petersheim et al. |
| 10,704,334 | B2 | 7/2020 | Jiang |
| 10,711,331 | B2 | 7/2020 | Chang et al. |
| 10,946,500 | B2 | 3/2021 | Chapman et al. |
| 12,042,868 | B2 * | 7/2024 | Zhan ..... C22C 26/00 |
| 2003/0052098 | A1 | 3/2003 | Kim et al. |
| 2008/0223623 | A1 | 9/2008 | Keshavan et al. |
| 2008/0312892 | A1 | 12/2008 | Heggemann |
| 2010/0276209 | A1 | 11/2010 | Yong et al. |
| 2011/0031026 | A1 | 2/2011 | Oxford et al. |
| 2011/0083908 | A1 | 4/2011 | Shen et al. |
| 2011/0271603 | A1 | 11/2011 | Voronin et al. |
| 2012/0097457 | A1 | 4/2012 | Setlur et al. |
| 2012/0125696 | A1 | 5/2012 | Belnap et al. |
| 2013/0056284 | A1 | 3/2013 | Atkins et al. |
| 2013/0067824 | A1 | 3/2013 | King et al. |
| 2013/0277121 | A1 | 10/2013 | Stevens et al. |
| 2013/0320598 | A1 | 12/2013 | Atkins et al. |
| 2014/0110180 | A1 | 4/2014 | Yu et al. |
| 2014/0123562 | A1 | 5/2014 | Voronin |
| 2014/0174633 | A1 | 6/2014 | Andersin et al. |
| 2014/0283457 | A1 | 9/2014 | Cariveau et al. |
| 2014/0318392 | A1 | 10/2014 | Sajgalik et al. |
| 2015/0075714 | A1 | 3/2015 | Sun et al. |
| 2015/0284833 | A1 | 10/2015 | Hsiao et al. |
| 2015/0292270 | A1 | 10/2015 | Zhang et al. |
| 2016/0312541 | A1 * | 10/2016 | Feehily ..... C23F 1/02 |
| 2018/0029942 | A1 | 2/2018 | Ishida |
| 2018/0058148 | A1 | 3/2018 | Zhang et al. |
| 2018/0126516 | A1 | 5/2018 | Kanyanta et al. |
| 2018/0202234 | A1 | 7/2018 | Saini et al. |
| 2018/0208511 | A1 | 7/2018 | Liang et al. |
| 2018/0215671 | A1 | 8/2018 | Sani et al. |
| 2018/0265416 | A1 | 9/2018 | Ishida et al. |
| 2018/0328117 | A1 * | 11/2018 | Bird ..... E21B 10/46 |
| 2019/0078390 | A1 | 3/2019 | Belnap et al. |
| 2020/0001367 | A1 | 1/2020 | Duffy et al. |
| 2021/0032934 | A1 | 2/2021 | Zhan et al. |
| 2021/0034029 | A1 | 2/2021 | Zhan et al. |
| 2021/0238102 | A1 | 8/2021 | Terasaki |
| 2021/0277721 | A1 | 9/2021 | Portwood et al. |
| 2021/0370396 | A1 | 12/2021 | Zhan et al. |
| 2021/0371345 | A1 | 12/2021 | Zhan et al. |
| 2022/0250989 | A1 | 8/2022 | Zhan et al. |
| 2023/0212914 | A1 | 7/2023 | Zhan et al. |

FOREIGN PATENT DOCUMENTS

| | | |
|---|---|---|
| CN | 104612583 | 5/2015 |
| CN | 105127430 | 12/2015 |
| CN | 103953279 | 2/2016 |
| CN | 106119763 | 11/2016 |
| CN | 103803985 | 8/2017 |
| CN | 108950561 | 12/2018 |
| CN | 109046179 | 12/2018 |
| CN | 109437920 | 3/2019 |
| CN | 110369714 | 10/2019 |
| EP | 0437855 | 7/1991 |
| EP | 3333141 | 6/2018 |
| GB | 1572460 | 7/1980 |
| GB | 1574615 | 9/1980 |
| GB | 2453435 | 4/2009 |
| JP | S 62274034 | 11/1987 |
| JP | 2009067609 | 4/2009 |
| JP | 4275896 | 6/2009 |
| JP | 5013156 | 8/2012 |
| WO | WO 81/003295 | 11/1981 |
| WO | WO 99/036658 | 7/1999 |
| WO | WO 2006032984 | 3/2006 |
| WO | WO 2010111578 | 9/2010 |
| WO | WO 2014088569 | 6/2014 |
| WO | WO 2017011415 | 1/2017 |
| WO | WO 2018167022 | 9/2018 |

OTHER PUBLICATIONS

PCT International Search Report and Written Opinion in International Appln. No. PCT/US2020/043411, dated Oct. 23, 2020, 15 pages.

PCT International Search Report and Written Opinion in International Appln. No. PCT/US2020/043872, dated Oct. 20, 2020, 25 pages.

PCT International Search Report and Written Opinion in International Appln. No. PCT/US2021/034192, dated Aug. 31, 2021, 14 pages.

PCT International Search Report and Written Opinion in International Appln. No. PCT/US2021/035424, dated Sep. 20, 2021, 15 pages.

(56) References Cited

OTHER PUBLICATIONS

PCT International Search Report and Written Opinion in International Appln. No. PCT/US2023/010037, dated Apr. 17, 2023, 20 pages.
GCC Examination Report in GCC Appln. No. GC 2020-40173, dated Sep. 26, 2021, 5 pages.
GCC Examination Report in GCC Appln. No. GC 2020-40176, dated Sep. 7, 2021, 3 pages.
Aghaei, "Atomic Layer Deposition: An Overview Al 2 O 3 ALD on Carbon Nanotubes and Graphene Surfaces," Chem. Rev., 2010, 110:111-131, 22 pages.
Commer et al., "New advances in three-dimensional controlled-source electromagnetic inversion," Geophys. J. Int., 2008, 172:513-535, 23 pages.
Durrand et al., "Thick PDC, Shaped Cutters for Geothermal Drilling: A Fixed Cutter Solution for a Roller Cone Drilling Environment," 44th U.S. Rock Mechanics Symposium and 5th U.S .—Canada Rock Mechanics Symposium, Jun. 2010, 11 pages.
Fabreguette et al., "Ultrahigh x-ray reflectivity from W/A12O3 multilayers fabricated using atomic layer deposition," Appl. Phys. Lett., 2006, 88, 013116, 3 pages.
Ju, "Rock Breaking Mechanism Analysis and Structure Design of the Conical PDC Cutter Based on Finite Element Method," Engineering Letters, Mar. 2019, 27(1):75-80, 6 pages.
Li et al., "Ultrastrong catalyst-free polycrystalline diamond," Nature Research, Scientific reports, Dec. 2020, 10:22020, 10 pages.
Liu et al., "Hardness of Polycrystalline Wurtsite Boron Nitride (wBN) Compacts," Scientific Reports, Jul. 2019, 9(1), 6 pages.
Liu et al., "Superstrong micro-grained polycrystalline diamond compact through work hardening under high pressure," Appl. Phys. Lett., Feb. 2018, 112, 6 pages.
Meta-Braze VBC Group, "Meta-Braze Cu93Ti: Copper based brazing alloy for ceramics, " 2018, 1 page.
Meta-braze.com [online], "Copper Brazing Alloys for Tungsten Carbide," available on or before Sep. 30, 2020 via Internet Archive Wayback Machine URL <https://web.archive.org/web/20200930185357/https://www.meta-braze.com/products/base-metal-brazing-alloys/copper-brazing-alloys-for-tungsten-carbide>, retrieved on Mar. 15, 2022, retrieved from URL <https://www.meta-braze.com/products/base-metal-brazing-alloys/copper-brazing-alloys-for-tungsten-carbide>, 2 pages.
Meta-braze.com [online], "Nickel based Brazing Alloys," available on or before Aug. 12, 2020 via Wayback Machine Archive URL <https://web.archive.org/web/20200812204140/https://www.meta-braze.com/products/base-metal-brazing-alloys/nickel-based-brazing-alloys>, retrieved on Mar. 15, 2022, retrieved from URL <https://www.meta-braze.com/products/base-metal-brazing-alloys/nickel-based-brazing-alloys>, 3 pages.
Metco, "An Introduction to Thermal Spray," 2013, Issue 4, 24 pages.
Thefreedictionary.com [online], "Paddle", Jan. 2004, retrieved on Apr. 12, 2021, retrieved from URL <https://www.thefreedictionary.com/paddle>, 8 pages.
U.S. Appl. No. 17/549,290, Xu et al., Producing Polycrystalline Diamond Compact Cutters With Coatings, filed Dec. 13, 2021, 61 pages.
U.S. Appl. No. 17/567,531, Zhan et al., Producing Polycrystalline Diamond Compact (PDC) Drill Bits With Catalyst-Free and Substrate-Free PDC Cutters, filed Jan. 3, 2022, 49 pages.
U.S. Appl. No. 17/740,741, Zhan et al., Fabricating Drill Bits, filed May 10, 2022, 47 pages.
Utkin et al., "Shock Compressibility and Spallation Strength of Cubic Modification of Polycrystalline Boron Nitride," High Temperature, 2009, 47(5):628-634, 7 pages.
Xiong et al., "Comparative analysis cutting characteristics of stinger PDC cutter and conventional PDC cutter," Journal of Petroleum Science and Engineering, 2020, 189:106792, 13 pages.
Zhan et al., "New Ultra-Strong and Catalyst-Free PDC Cutting Element Technology," IPTC-19764-MS, International Petroleum Technology Conference, Jan. 13-15, 2020, 12 pages.
PCT International Search Report and Written Opinion in International Appln. No. PCT/US2023/019553, dated Jul. 18, 2023, 20 pages.
PCT International Search Report and Written Opinion in International Appln. No. PCT/US2024/015728, dated Jul. 1, 2024, 12 pages.

* cited by examiner

PRODUCING HYDRO-EFFLUX HAMMER USING CATALYST-FREE PDC CUTTERS

CROSS REFERENCE TO RELATED APPLICATIONS

This application is a continuation-in-part of U.S. patent application Ser. No. 17/336,637 filed on Jun. 2, 2021, which claims the benefit of U.S. Provisional Application Ser. No. 63/033,669, filed on Jun. 2, 2020, the entire contents of both of which are incorporated herein by reference in their entirety.

TECHNICAL FIELD

The present disclosure relates to production of polycrystalline diamond (PCD) compact (PDC) cutters and, particularly, PDC drill bits for the oil and gas industry.

BACKGROUND

Drilling hard, abrasive, and interbedded formations poses a difficult challenge for conventional PDC drill bits where the PDC cutter is formed using conventional high pressure and high temperature (HPHT) technology. Historically, a conventional PCD material, generally forming a cutting layer, also called diamond table, dulls quickly due to abrasive wear, impact damage, and thermal fatigue. Thus, hardness, fracture toughness, and thermal stability of PCD materials represent three limiting factors for an effective PDC drill bit.

SUMMARY

Some methods of forming a drill bit cutter include: pressurizing, to synthesize polycrystalline diamond (PCD) having a cross-sectional dimension of at least 8 millimeters (mm), a diamond powder to a pressure of at least 5 gigapascals (GPa); heating the diamond powder to at least 1000° C.; pressurizing the diamond powder to a pressure of at least 14 GPa; and heating the diamond powder at a heating rate of between 10° C. to 1000° C. per minute to a synthesis temperature of between 1000° C. and 3000° C.; and cooling the PCD at a cooling rate of between 10° C. to 1000° C. per min to a temperature of between room temperature to 2000° C.

Some computer implemented methods performed by one or more processors for forming a drill bit cutter include the following operations: pressurizing, to synthesize a polycrystalline diamond (PCD) having a cross-sectional dimension of at least 8 millimeters (mm), a diamond powder to a pressure of at least 5 GPa; heating the diamond powder to at least 1000° C.; pressurizing the diamond powder to a pressure of at least 14 GPa for between 1 and 60 minutes; and heating the diamond powder at a heating rate of 200° C. per minute to a temperature of 1000° C. to 2000° C.; and cooling the PCD at a cooling rate of 50° C. per min.

Some apparatuses for forming a drill bit cutter include: one or more processors; and a non-transitory computer-readable storage medium coupled to the one or more processors and storing programming instructions for execution by the one or more processors, the programming instructions instructing the one or more processors to: pressurizing, to synthesize a polycrystalline diamond (PCD) having a cross-sectional dimension of at least 8 millimeters (mm), a diamond powder to a pressure of at least 5 gigapascals (GPa); heating the diamond powder to at least 1000° C.; pressurizing the diamond powder to a pressure of at least 14 GPa; heating the diamond powder at a heating rate of 200° C. per minute to a temperature of 1000° C. to 2000° C.; cooling the PCD at a cooling rate of 50° C. per min; and coupling the cooled PCD to a substrate comprising tungsten carbide to form a PDC cutter.

Implementations of these methods and apparatuses can include one or more of the following features.

In some implementations, performing an ultra-high pressure and high temperature operation on diamond powder to synthesize polycrystalline diamond (PCD) having a minimum dimension of at least 8 mm further comprises coupling the cooled PCD to a substrate comprising tungsten carbide to form a polycrystalline diamond compact (PDC) cutter.

In some implementations, the diamond powder comprises particles having a size within a range of 8 micrometers (μm) to 50 μm. In some implementations, the diamond powder comprises particles having a size within a range of 8 μm to 12 μm. In some implementations, the diamond powder comprises particles having a size within a range of 0.1 μm to 100 μm.

In some implementations, the PCD has a dimension within a range of 5 mm to 50 mm.

In some implementations, the PCD has a circular cross-sectional shape and wherein the PCD has a diameter of the cross-sectional shape that is within a range of 5 mm to 50 mm.

In some implementations, coupling the cooled PCD to a substrate comprising tungsten carbide to form a PDC cutter comprises coupling the cooled PCD to the substrate by vacuum diffusion bonding, hot pressing, spark plasma sintering, microwave joining, or high-pressure, high temperature (HPHT) bonding.

In some implementations, cooling the PCD at a cooling rate of 50° C. per min comprises cooling the PCD to between 1500° C. to 2000° C. Some implementations also include maintaining the PCD at between 1500° C. to 2000° C. for 5 to 60 minutes.

In some implementations, performing an ultra-high pressure and high temperature operation on diamond powder to synthesize polycrystalline diamond (PCD) having a minimum dimension of at least 8 mm further comprises coupling the cooled PCD to a substrate comprising tungsten carbide to form a polycrystalline diamond compact (PDC) cutter.

In some implementations, the steps of pressurizing the diamond powder comprise operating a cubic press to pressurize the diamond powder.

In some implementations, the steps of heating the diamond powder comprise passing an electric current through a heater adjacent to the diamond powder.

In some implementations, pressurizing the diamond powder to the pressure of at least 14 GPa comprises maintaining the pressure for between 10 to 60 minutes. In some cases, cooling the PCD at the cooling rate of 50° C. per min comprises cooling the PCD to between 1500° C. to 2000° C.

In one aspect, a method of forming a bottom hole assembly includes forming a plurality of cutters, each cutter comprising a catalyst-free synthesized polycrystalline diamond attached to a carbide substrate; attaching the plurality of cutters to a body of a drill bit; and incorporating the drill bit with the attached cutters into a hydro-efflux hammer system.

In one aspect, a hydro-efflux hammer system includes a hydro-efflux hammer and a drill bit, the drill bit including a plurality of cutters attached to a body of the drill bit, each cutter including a catalyst-free synthesized polycrystalline diamond attached to a carbide substrate.

In one aspect, a method of forming a drill bit includes forming a plurality of cutters, each cutter comprising a catalyst-free synthesized polycrystalline diamond attached to a carbide substrate and attaching the plurality of cutters to a body of the drill bit.

In one aspect, a drill bit includes a plurality of cutters attached to a body of the drill bit, each cutter including a catalyst-free synthesized polycrystalline diamond attached to a carbide substrate.

In some implementations, forming the catalyst-free synthesized polycrystalline diamond includes applying a pressure of at least 14 GPa during processing of the catalyst-free synthesized polycrystalline diamond.

In some cases, the catalyst-free synthesized polycrystalline diamond is processed to a temperature of at least 1900° C. during processing of the catalyst-free synthesized polycrystalline diamond.

In some implementations, the catalyst-free synthesized polycrystalline diamond has a diameter of at least 8 mm. In some cases, the catalyst-free synthesized polycrystalline diamond has a diamond table thickness of at least 3 mm.

In some implementations, the catalyst-free synthesized polycrystalline diamond has a planar end surface.

In some implementations, the catalyst-free synthesized polycrystalline diamond has a non-planar end surface. In some cases, the catalyst-free synthesized polycrystalline diamond has a conical end surface.

In some implementations, forming a plurality of cutters includes providing a substrate including tungsten carbide and attaching the catalyst-free synthesized PCD to the substrate comprising tungsten carbide to form a PDC cutter.

In some implementations, attaching the plurality of cutters to the body of the drill bit includes brazing the plurality of cutters to the body of the drill bit at more than 750° C.

The details of one or more embodiments of the present disclosure are set forth in the accompanying drawings and the description that follows. Other features, objects, and advantages of the present disclosure will be apparent from the description and drawings, and from the claims.

DESCRIPTION OF DRAWINGS

Like reference symbols in the various drawings indicate like elements.

DETAILED DESCRIPTION

Figure 1:
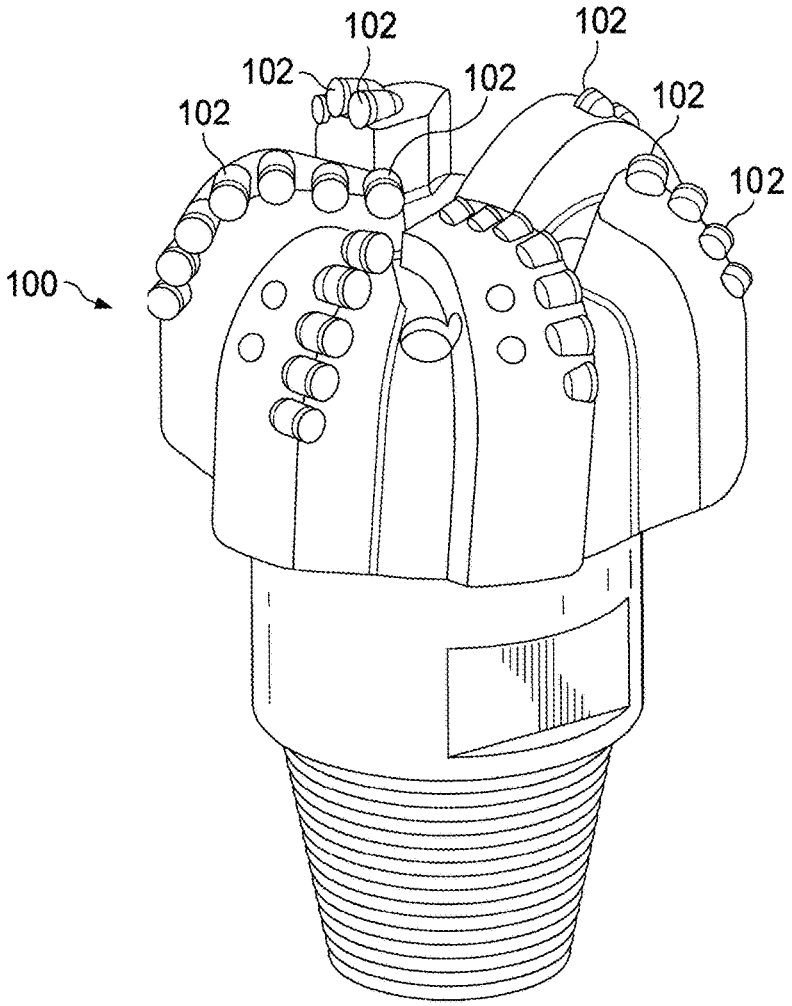
FIG. 1 is a perspective view of an example drill bit used in the oil and gas industry for forming a wellbore.

For the purposes of promoting an understanding of the principles of the present disclosure, reference will now be made to the implementations illustrated in the drawings, and specific language will be used to describe the same. Nevertheless, no limitation of the scope of the disclosure is intended. Any alterations and further modifications to the described devices, systems, methods, and any further application of the principles of the present disclosure are fully contemplated as would normally occur to one skilled in the art to which the disclosure relates. In particular, it is fully contemplated that the features, components, steps, or a combination of such described with respect to one implementation may be combined with the features, components, steps, or a combination of such described with respect to other implementations of the present disclosure.

This present disclosure relates to the manufacture of catalyst-free PCD materials for use in drill bit and, particularly, in drill bits used for oil and gas wellbore formation. The PCD materials are formed from micro-sized diamond particles and are formed using an ultra-high pressure and high temperature (UHPHT) technology. The formed PCD materials provide superior abrasive wear, impact damage, and thermal fatigue, thereby overcoming the deficiencies of current PCD materials formed using the high pressure, high-temperature (HPHT) technology. In some instances, the PCD material has a hardness of single-crystal diamond, which is more than twice as high as the hardness of current PDC cutters. Additionally, in some instances, the PCD produced using the UHPHT technology has a fracture toughness that approaches that of metallic materials. As a result, the PCD material of the present disclosure provides increased drill bit performance, improved drill bit life, and improved cutting efficiency.

Figure 2A:
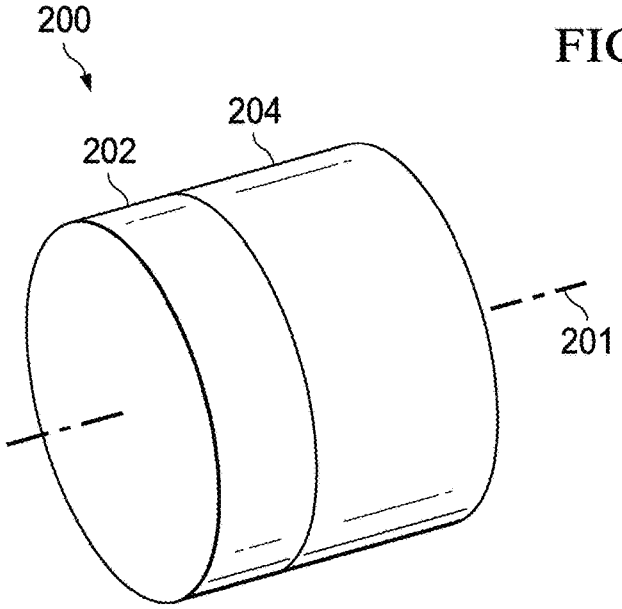
FIG. 2A is a perspective view of an example PDC cutter.
Figure 2B:
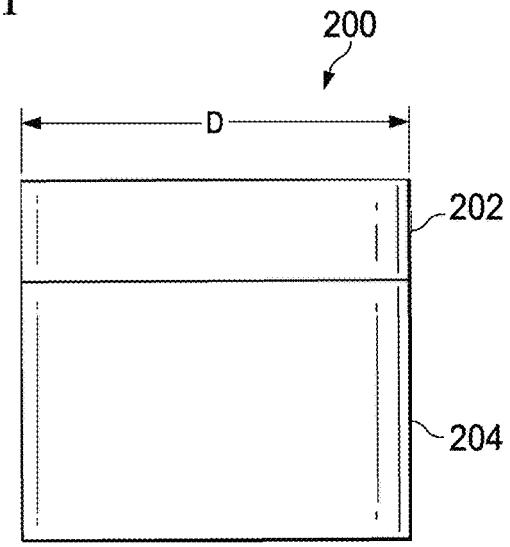
FIG. 2B is a cross-sectional view of the example PDC cutter of FIG. 2A.

FIG. 1 is a perspective view of an example drill bit 100 used in the oil and gas industry for forming a wellbore. The drill bit 100 includes a plurality of polycrystalline diamond compact (PDC) cutters 102. The PDC cutters operate to cut into rock to form a wellbore. FIG. 2A is a perspective view of an example PDC cutter 200 similar to the PDC cutter 102. FIG. 2B is a cross-sectional view of an example PDC cutter 200 taken along a plane containing centerline 201. Similar to the PCD cutter 102, the PDC cutter 200 is disc-shaped, and, like the PDC cutter 102, the PDC cutter 200 includes a PCD layer 202 and a substrate 204. In some implementations, the PCD layer 202 has a thickness within a range of 2 millimeters (mm) to 4 mm. However, in other implementations, the PCD layer 202 may have a thickness greater than or less than the indicated range. In some implementations, the substrate 204 has a thickness within a range of 9 mm to 11 mm. However, in other implementations, the substrate 204 may have a thickness greater than or less than the indicated range.

In the illustrated example of FIG. 2B, the PDC cutter 102 has a circular transverse cross-sectional shape. A diameter D of the PDC cutter 102 varies according to a desired size of the PDC cutter 102. For example, in some implementations, the PDC cutter 102 may have a diameter D within a range of 8 mm to 48 mm. However, in other implementations, the diameter D of the PDC cutter 102 may be greater than or less than the indicated range. As shown in FIG. 2A, the example PDC cutter 102 has a cylindrical shape. In other implementations, the cutter may have a tapered shape. In some implementations, a cross-sectional size of the PCD layer 202 may be different from a cross-sectional size of the substrate 204. Still further, in other implementations, the transverse cross-sectional shape of the PDC cutter 102 may be other than circular. In still other implementations, the PCD layer 202 may have a non-circular cross-sectional shape. For example, the PCD layer 202 may be oval, square, rectangular, or have an irregular shape. A cross-sectional dimension of the PCD layer 202 may be within a range of 8 mm to 48 mm.

The PCD layer 202 is formed from a PCD material formed using UHPHT technology. In some implementations, the substrate 204 is formed from a mixture of tungsten carbine (WC) and cobalt (Co). In some implementations, cobalt may form 1% to 20% by weight of the WC-Co mixture. Further, as discussed in more detail later, the substrate 204 may be formed from a powder during manufacturing of the PDC cutter 102.

The UHPHT technology involves forming the PCD material using compressive pressures within a range of 10 gigapascals (GPa) to 35 GPa and temperatures within a range of 2000 Kelvin (K) to 3000 K.

Figure 3:
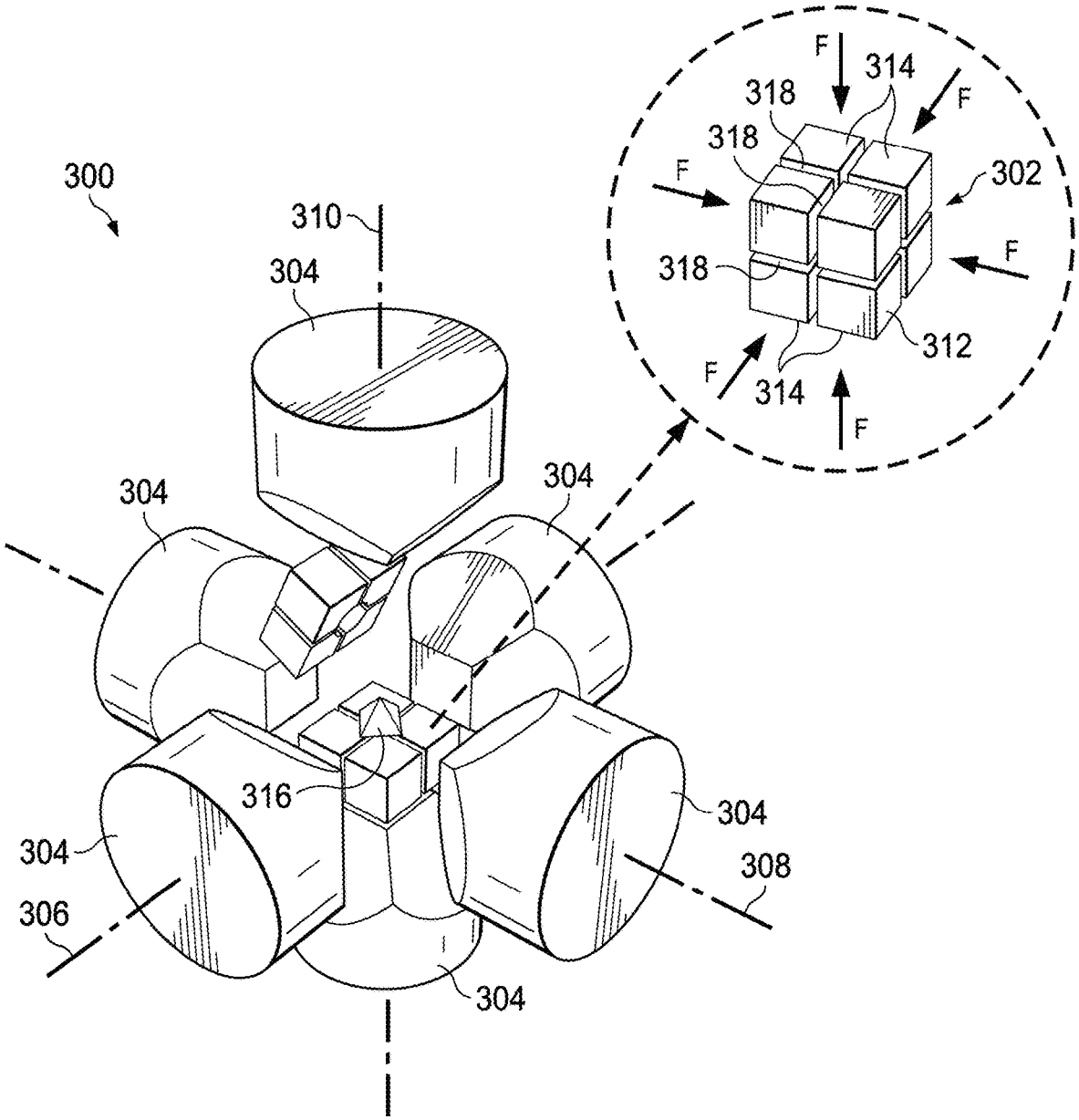
FIG. 3 is a detail view of components of an example two-stage, multi-anvil cubic press used to form a PCD material for use as a PCD layer in a PDC cutter.

In some implementations, the PCD material is formed using a two-stage, multi-anvil cubic press. For example, the 6-8 type, DS6×25 MN cubic press machine produced by Chengdu Dongwei Science and Technology Company of 2039 South Section of Tianfu Avenue, Tianfu New District, Chengdu 610213, Sichuan Province, P. R. China, may be used to form the PCD layer 202. FIG. 3 is a detail view of components of an example two-stage, multi-anvil cubic press used to form a PCD material for use as a PCD layer in a PDC cutter. These components include a first stage 300 and a second stage 302. The first stage 300 includes six anvils 304. The anvils 304 are arranged in aligned pairs along each axis of an orthogonal coordinate system. A pair of aligned anvils 304 are disposed along a first axis 306 (x-axis); a pair of aligned anvils 304 are disposed along a second axis 308 (y-axis) and a third axis (z-axis) 310. The axes 306, 308, and 310 are perpendicular to one another.

Figure 4:
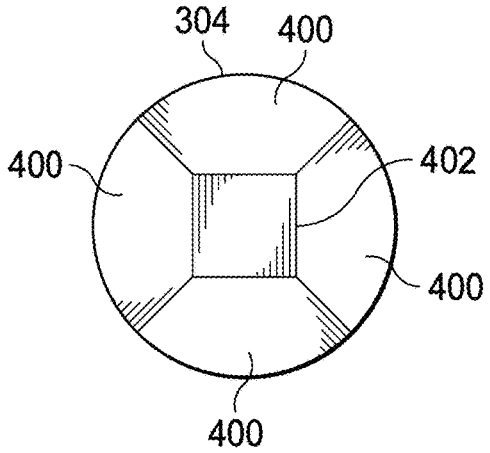
FIG. 4 is an end view of an example anvil used in a cubic press.

FIG. 4 is an end view of one of the anvils 304. Each of the anvils 304 has chamfered edges 400 that define a central contact surface 402. The chamfered edges 400 of an anvil 304 provide reliefs for adjacent anvils 304 such that the contact surfaces 402 of each anvil 304 are able to engage the second stage 302, described in more detail later.

Referring again to FIG. 3, the second stage 302 is a booster 312 that includes eight cubes 314 that, collectively, define a cavity 316. In the illustrated example, the cavity 316 is in the form of a square octahedron. Other cavity shapes may be used. For example, in other implementations, the booster 312 may define a cylindrical cavity, such as a cylinder having a circular cross-sectional shape. The cubes 314 are formed from WC-Co. The cubes 314 collectively form the booster 312 having a cubic shape, and each contact surface 402 of the anvils 304 contacts one of the end surfaces of the booster 312. The cavity 316 formed by the booster 312 is filled with a material to be compressed, and the cubes 314 are cemented together to form the unitary booster 312 using, for example, WC/Co cement. Strips 318 (e.g., strips of pyrophillite) are positioned between the cubes 314 and, during compression, act to form a seal between adjacent cubes 314.

In some implementations, the two-stage, multi-anvil press provides a 36/20 assembly, where "36" represents a length of a side of the cubic booster 312, and where "20" represents a length of a side of the square contacting surface 402 of the anvils 304. However, other assembly sizes are within the scope of the present disclosure. For example, assemblies of the following sizes are also within the scope of the present disclosure: 10/4, 14/6, 14/7, 16/7, 18/8, 18/9, 25/15, and 38/22. Other sizes may also be used.

The cavity 316 is filled with a diamond powder. In some implementations, the diamond power may have a grain or particle size of between 8 micrometers (μm) to 12 μm. In some implementations, the powder may have particle sizes up 50 μm. In some implementations, the powder may have particle sizes down to 0.5 μm. The diamond powder is treated in a vacuum furnace at approximately 1200° C. (e.g., between 1150 and 1250° C.) for approximately 90 minutes. For example, a vacuum pressure of 2×10-4 Torr can be applied to the diamond powder in the vacuum furnace. At this step, the diamond particles are still in a loose granular state during this treatment. In some implementations, the diamond powder is placed in a corundum container, which is introduced into a vacuum furnace. A vacuum is applied to the vacuum furnace until the pressure within the vacuum furnace is approximately $2\times10^{-4}$ Torr. The diamond particles are heated at a rate of approximately 15° C. per minute until a temperature of approximately 1200° C. is reached. The diamond powder is kept at 1200° C. and $2\times10^{-4}$ Torr for 90 minutes, after which the diamond powder is cooled to room temperature at a rate of approximately 5° C. per minute.

Figure 5A:
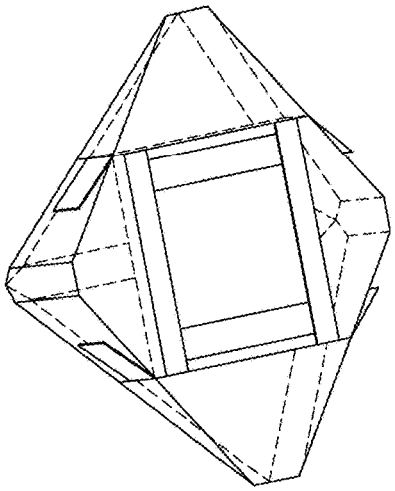
FIGS. 5A and 5B are schematic views of a capsule used to form a PCD.
Figure 5B:
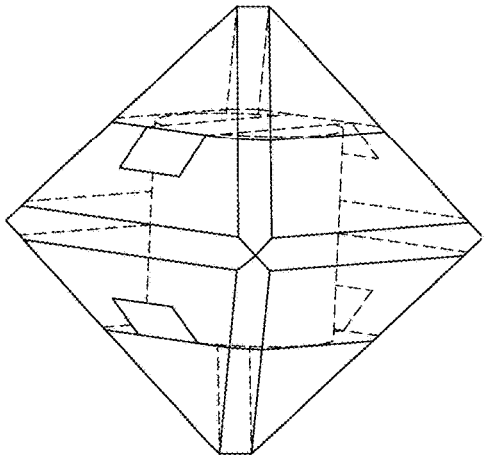

With the vacuum furnace treatment complete, the diamond particles are incorporated into a capsule 500, shown in FIGS. 5A-5B. In some implementations, the diamond powder is pressed into a pellet with a relative density of around 78% and prior to introduction into the cylindrical capsule 500. In other implementations, the cylindrical capsule 500 is pressed into a pellet with a relative density of about 78% prior to introduction into the cavity 316. In some implementations, the cylindrical capsule 500 has a diameter of approximately 13 millimeters (mm) and thickness of approximately 6.3 mm. However, a size of the cylindrical capsule 500 may depend on other factors, such as the size of the PCD material desired, a size of the cubic press, or other factors. The diamond particles 402 are packed into a capsule 500. In some implementations, the capsule 500 is a cylindrical capsule. The capsule 500 includes a metal foil 404 made of 99.95% pure tantalum (Ta). The capsule 500 also includes a magnesium oxide (MgO) sleeve 406 placed over the metal foil 404. The metal foil 404 made of tantalum serves as a heater when an electric current is applied through the booster 312, and the $ZrO_2$ serves as an insulator.

The capsule 500 is placed in the cavity 316 of the booster 312. A mixture of 99.99% pure magnesium oxide doped chromium trioxide ($Cr_2O_3$), at five percent by weight, is also introduced into the cavity 316 and serves as a pressure-transmitting medium. With the cylindrical capsule and the pressure-transmitting medium added to the cavity 316, the booster 312 is enclosed and cemented with the strips 318 disposed between adjacent cubes 314. The booster 312 loaded with the diamond powder is placed in between the anvils 304 of the first stage 300 of the cubic press.

With the booster 312 in position, the anvils 304 are advanced and engage the booster 312. A central contact surface 402 of each anvil 304 contacts an adjacent exterior surface of the booster 312. Consequently, as loading is applied to the booster 312 by the anvils 304, the anvils 304 apply loads in six directions on the outer six surfaces of the booster 312. The loading applied by the anvils 304 push the cubes 314 towards each other, compressing the pressure-transmitting medium, thereby generating large pressures within the cavity 316. As the anvils 304 are advanced, the booster 312 deforms such that WC-Co material forming the cubes 314 is displaced into the gaps formed between adjacent anvils 304 at adjacent chamfered edges 402. As a result, this displaced WC-Co material forms sealing edges between the adjacent anvils 304. In some cases, the sealing material is pryophillite that is squeezing out to fill the gaps of the anvils to prevent the anvils from directly contacting each other. The central contact surfaces 402 and the sealed edges combine to form a two-stage pressure chamber. As loading is applied to the booster 312, the strips 318 placed between the cubes 314 and the pressure-transmitting medium are squeezed and flow to form a sealing edge between the adjacent cubes 314.

Figure 6:
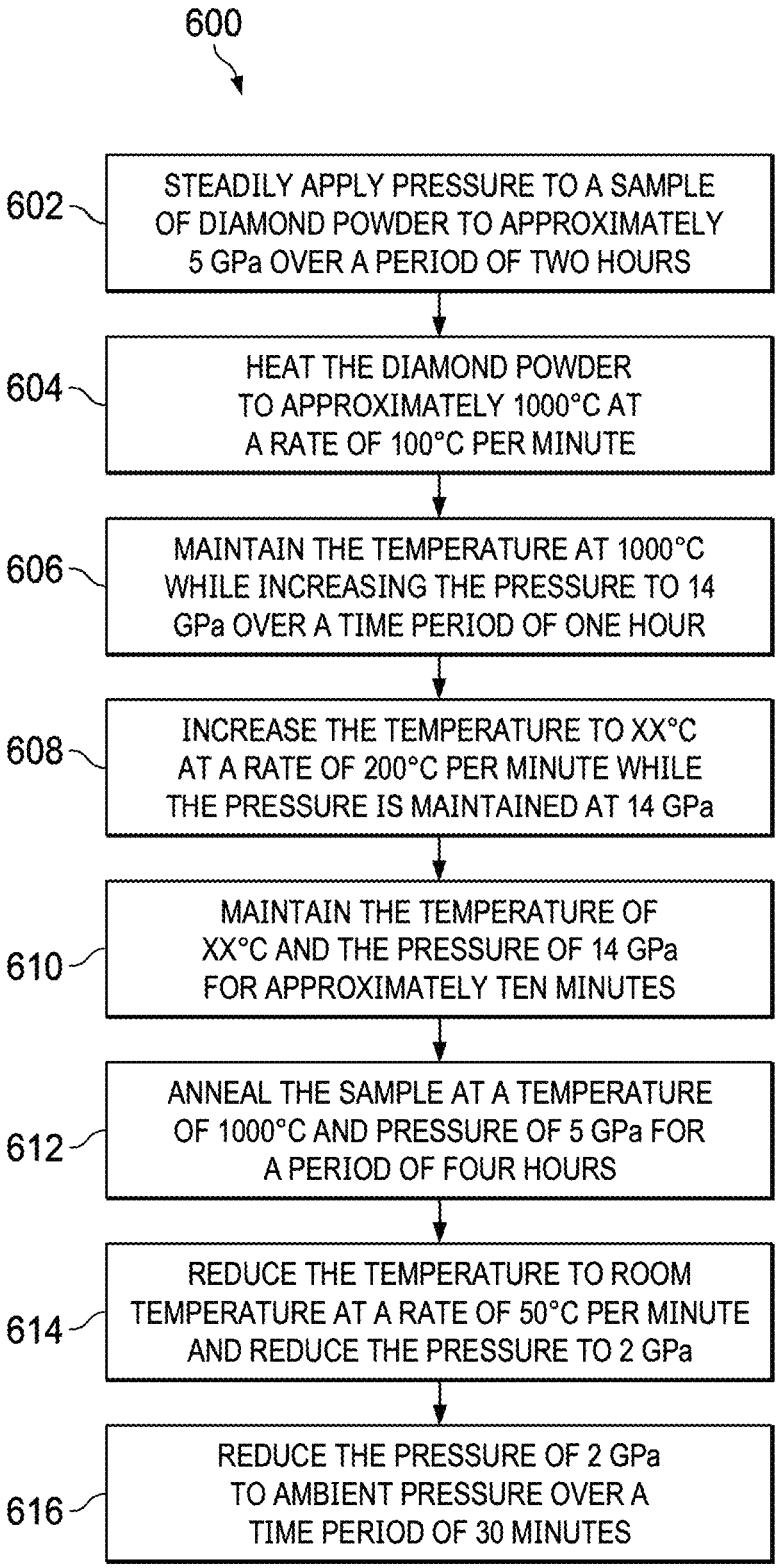
FIG. 6 is a flowchart of an example UHPHT method for generating PCD material to form a PCD layer of a PDC cutter.

FIG. 6 is a flowchart of an example UHPHT method 600 for generating PCD material to form a PCD layer of a PDC cutter. At 602, a pressure applied to a sample of diamond powder is steadily increased to approximately 5 GPa over a period of two hours. The pressure may be applied to the sample of diamond powder by a set of anvils of a cubic press, such as the anvils 304 described earlier. The set of anvils applies the pressure to the diamond powder via a booster, such as the booster 312 described earlier, to increase the pressure on an amount of diamond powder. At 604, the diamond powder is heated to approximately 1000° C. at a rate of 100° C. per minute. As explained earlier, the diamond powder may be disposed within a capsule containing tantalum foil. A current may be passed through the booster and through the tantalum foil, which heats in response to the current, thereby heating the diamond powder. This temperature is typically applied 30-60 minutes before the pressure is increased for the purpose of pre-heating of diamond powder. The pre-pressuring of 5 GPa is to keep diamond powder stable while not transforming to graphite at heating. At 606, the temperature is maintained at 1000° C. constant and the pressure is increased to 14 GPa over a time period of one hour. After this pressure is obtained, the pressure maintained for at least 2-4 minutes before the next step occurs. At 608, the temperature is increased to 1000-2000° C. at a rate of 200° C. per minute while the pressure is maintained at 14 GPa. The temperature and pressure are the peak P-T conditions" determined based on the diamond-graphite phase diagram.

At 610, the temperature and the pressure of 14 GPa are maintained for approximately ten minutes. At 612, the sample is annealed at a temperature of 1000° C. and pressure of 5 GPa for a period of four hours. The temperature in the previous step is reduced from the designed or desired synthesis temperature to 1000° C. The temperature is reduced and then the pressure is reduced. At 614, the temperature is reduced to room temperature at a rate of 50° C. per minute and the pressure is reduced to 2 GPa. At 616, the pressure of 2 GPa is reduced to ambient pressure over a time period of 30 minutes. The temperature is reduced first before the pressure is gradually reduced to help avoid the occurrence of anvil "blow-out" (breakage).

UHPHT PCD production methods encompassed by the present disclosure may take from eight hours to twelve hours to complete. Further, although the example method 500 describes a maximum pressure applied to the sample of 14 GPa, the UHPHT methods encompass ultra-high pressures within a range of 10 GPa to 35 GPa. More generally, ultra-high pressures of a UHPHT method are greater than pressures used in conventional HPHT methods. Conventional HPHT methods involve pressures within a range of 5.5 GPa and 7 GPa. Thus, pressures in excess of those used in conventional HPHT methods are UHPHT pressures within the scope of the present disclosure. Further, although an upper range of 35 MPa is indicated, in other implementations, UHPHT methods within the scope of the present disclosure may use pressures that exceed 35 MPa.

With the UHPHT method complete, the sample is extracted, such as from a cubic press. In some implementations, the sample is subjected to an acid treatment to remove the one or more components included with the diamond powder sample. For example, where the diamond powder is incorporated into a capsule, such as capsule 500 described earlier, the capsule is subjected to an acid treatment to remove tantalum foil. Further, in some implementations, the sample is washed in water, followed by a wash in ethanol using an ultrasonic bath. The ultrasonic bath used in washing with first water and then ethanol.

The UHPHT methods cause the diamond powder to form a polycrystalline form. The UHPHT systems and methods described in the present disclosure excludes the use of a catalyst to promote sintering and the formation of PCD. PCD material formed using traditional methods are formed at lower pressures and require the use of a catalyst, such as cobalt, to promote sintering and the formation of the PCD. However, during drilling, the catalyst heats and expands, damaging bonding between the PCD and the underlying substrate, causing separation of the PCD individual grains within the diamond table and as well the interface from the substrate and, hence, the drilling bit. As a result, drilling performance is dramatically reduced.

The higher pressures associated with the UHPHT systems and methods of the present disclosure promotes sintering of the diamond particles to form PCD without the use of a catalyst. As a consequence, the PCD material and associated PDC drill bits of the present disclosure do not suffer from the problems experienced by current drill bits containing PCD as a result of the use of a catalyst.

The starting diamond powder and the resulting PCD material formed using a UHPHT method may be examined prior to and after the UHPHT manufacturing process, respectively. For example, the diamond powder may be subject to powder X-ray diffraction (XRD) using an X-ray diffractometer. Cu $K_\alpha$ radiation having a wavelength, $\lambda$, of 0.15406 nm applied at 0.01° per second over a $2\theta$ range of 10° to 100°. The synthesized PCD material may also be subjected to a similar X-ray diffraction technique. The X-ray diffraction is used to characterize the starting diamond powder and the synthesized PCD material at room temperature. Following synthesis, the ends of the PCD material may be polished using, for example, using a diamond wheel. For conventional PDC cutters, cutting layer polishing may take a day or two but the UHPHT cutting element or material polishing typically take one to two weeks due to its ultra-high hardness. The morphology of the ends-polished PCD samples may be examined using a scanning electron microscope (SEM). Micro-structures of a PCD samples may also be characterized using transmission electron microscopy (TEM) using an accelerating voltage of 200 kilovolts (KV). Archimedes' Method may be used to measure a volume density of the UHPHT produced PCD samples, and a relative density may be calculated using quantitative analysis of phase reference intensity with XRD. A micro-Raman scattering spectra may be collected at room temperature on a confocal Raman spectrometry system in the backscattering geometry based on a triple grating monochromator with an attached electron multiplying charged coupled device (EMCCD). The PCD sample is excited using a solid-state laser at 532 nanometers (nm), and the backscattering is collected using a 100 times, 0.90 numerical aperture (NA) objective lens.

Additionally, a Vickers hardness (Hv) test may be performed on the end-polished PCD samples using a Vickers single crystalline diamond indenter system. A loading force for the Vickers hardness test may be 29.4 Newtons (N) with a dwelling time of fifteen seconds. A length of microcracks produced in a PCD sample by the Vickers indenter may be measured with a SEM. In some instances, the Vickers hardness of the PCD samples synthesized using UHPHT methods reaches 120 GPa, which represents an upper limit of a single crystal diamond. In some instances, the PCD samples also include a fracture toughness as high as 18.7 MPa$\sqrt{m}$, which is a near-metallic fracture toughness. These values greatly exceed those associated with PCD materials formed using conventional methods. For example, in some instances, a conventionally-formed PCD material using HPHT technology has a Vickers hardness of approximately 50 GPa and a fracture toughness of approximately 8 MPa $\sqrt{m}$.

Figure 7A:
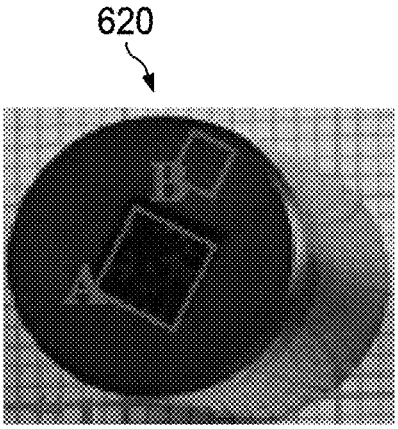
FIG. 7A and FIG. 7B are photographs of commercial cutters.
Figure 7B:
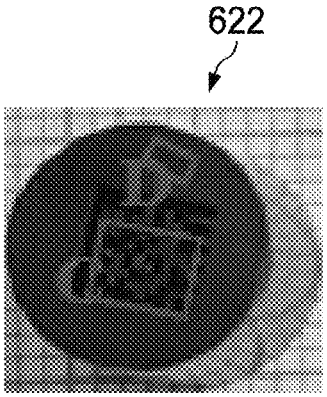
Figure 7C:
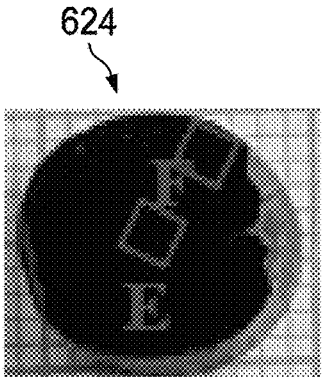
FIG. 7C and FIG. 7D are photographs of PCD layers for cutters produced using the approach described with reference to FIG. 6.
Figure 7D:
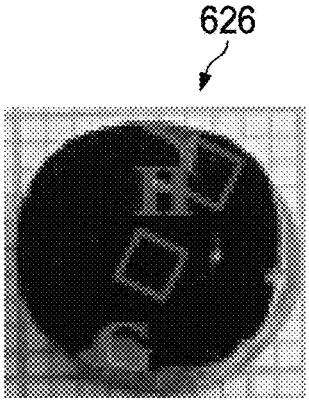

FIGS. 7A-FIG. 7B are photographs of commercial cutters (FIG. 7A and FIG. 7B) and PCD layers for cutters produced using the approach described with reference to FIG. 6 at a pressure of 16 G-Pa (FIG. 7C and FIG. 7D). The commercial cutters include a diamond cutting layer and a WC-Co substrate and are commercially available from suppliers such as Kennametal and Zhuzhou Cemented Carbide. The commercial cutters and the PCD layers are generally cylindrical in shape. The commercial cutter 620 (Sample 1) shown in FIG. 7A had a diameter of ~13.4 millimeters (mm) and a height of ~13.2 mm. The commercial cutter 622 (Sample 2) shown in FIG. 7B had a diameter of ~10 mm and a height of ~8 mm. The PCD layer 622 (Sample 3) shown in FIG. 7C had a diameter of ~10 mm and a height of ~4.5 mm. The PCD layer 626 (Sample 4) shown in FIG. 7D had a diameter of ~10 mm and a height of ~4.4 mm. Various tests were performed to compare the properties of commercial available cutters against PCDs formed by the approaches described in this specification.

FIGS. 7A-7D include boxes annotating the location of Raman test performed to measure residual stress of the samples. The residual stress of a sample can be determined using the formula $$\sigma_\varphi = \frac{(\nu_0 - \nu_1)}{2.88} \quad \text{(Eq. 1)}$$

where $\sigma_\varphi$ is residual biaxial stress, $v_0$ is the unstressed diamond Raman peak shift measured on a diamond plate and $\upsilon_1$ is the measured diamond Raman shift in the surface of the sample. The reference sample of an unstressed Raman peak was 1332.32 $cm^{-1}$. The results of this analysis are presented below in Table 1. For baseline PDC cutters, the central locations A and C were laser marked. All stress unit is negative, suggesting compression internal residual stress from manufacturing. For laser marking location, the stress is lower than that of un-marked areas, suggesting laser marking heating to relief a certain residual stress. For UHPHT PCD disks, the residual stresses in central and edge areas are similar due to not using laser marking the samples.

TABLE 1

| | Baseline Cutter Sample 1 | | Baseline Cutter Sample 2 | |
|---|---|---|---|---|
| | A (Laser marking) | B | C (laser marking) | A |
| $\upsilon_1$ ($cm^{-1}$) | 1334.22 | 1335.49 | 1334.56 | 1335.01 |
| $\sigma$ (GPa) | −0.66 | −1.03 | −0.78 | −0.93 |
| | UHPHT PCD Sample 1 | | UHPHT PCD Sample 2 | |
| | A | B | C | D |
| $\upsilon_1$ ($cm^{-1}$) | 1334.49 | 1334.86 | 1334.8 | 1334.93 |
| $\sigma$ (GPa) | −0.75 | −0.88 | −0.86 | −0.91 |

Figure 8:
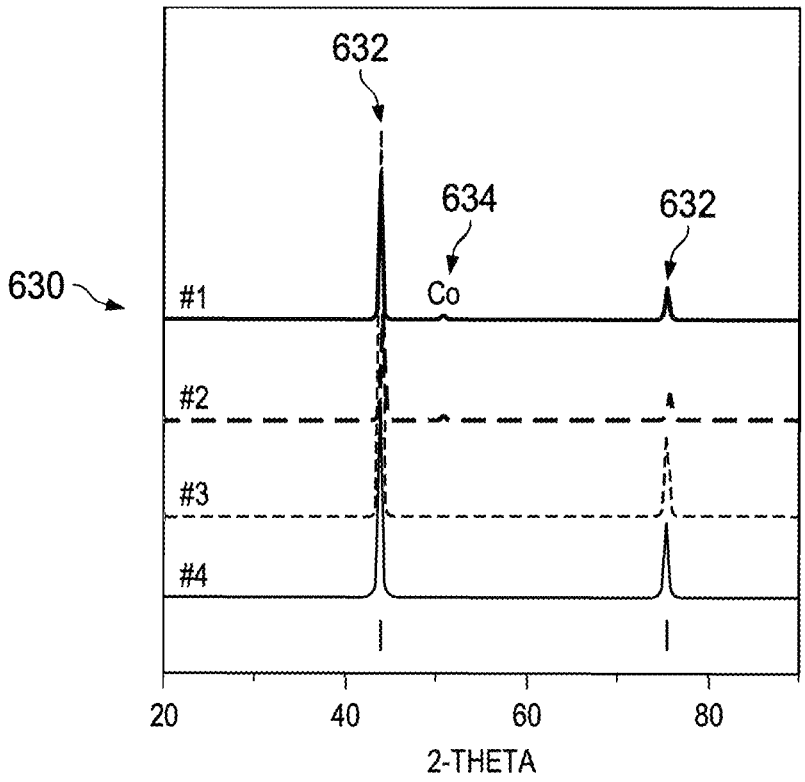
FIG. 8 presents x-ray diffraction (XRD) measurements for the samples shown in FIGS. 7A-7D.

FIG. 8 presents x-ray diffraction (XRD) measurements for the samples shown in FIGS. 7A-D. The XRD measurements presented on the chart 630 were performed using a DX-2500 $\Theta/2\Theta$ diffractometer. The x-ray radiation source of Cu $K\alpha$ with a wavelength of 0.15406 nm was operated at 40 kV and 25 mA. The scanning angle ($2\Theta$) was in the region of 20~100° and the sample surface was scanned with a step size of 0.03° and counting time of 1 second. There are two peaks 632 associated with diamond and one peak 634 associated with cobalt. The Samples 1 and 2 (i.e., the commercial cutters) were composed of diamond and cobalt. In contrast, Samples 3 and 4 contained only diamond.

Figure 9A:
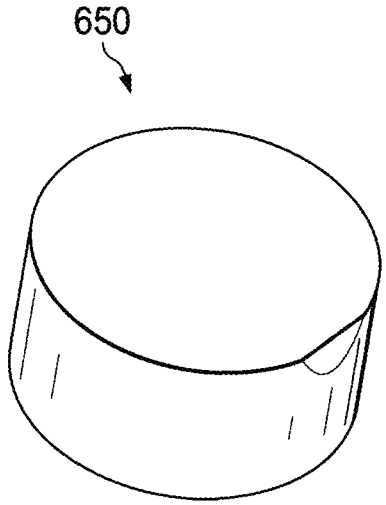
FIG. 9A and FIG. 9B are schematics illustrating wear resistance measured using turning tests.
Figure 9B:
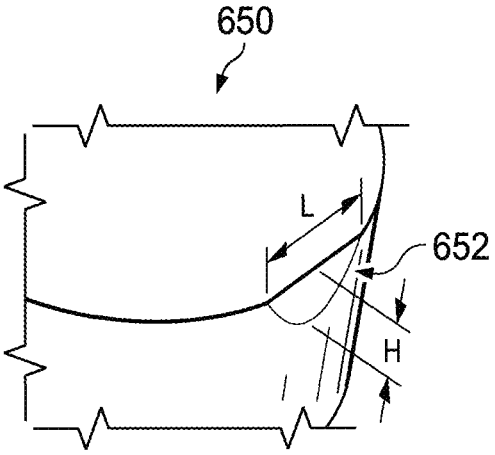

FIG. 9A and FIG. 9B are schematics illustrating wear resistance measured using turning tests. Turning tests are performed by abrading a sample (e.g., sample 650 in FIG. 9A) against a workpiece and optically and accurately measuring the amount (e.g., sample portion 652) of the sample 650 that is worn away. The wear resistance of polycrystalline diamond (PCD) cutter diamond table and UHPHT PCD disks, which are cylindrical in form (both the same diameter and height), in turning granite at a constant liner speed was investigated. The wear resistance is characterized as the ratio of the loss of volume of the diamond layer to the volume of machined granite material removed (when it is a dimensionless number). In a turning test, the wear ratio of a sample is calculated as the workpiece removal volume divided by sample wear volume. Turning tests were performed on Sample 2 (a diamond table or layer from the baseline PDC cutter—the best PDC cutter currently used in the industry) and Sample 4 (14-GPa UHPHT PCD diamond) using a granite workpiece. The wear ratio for Sample 2 was $1.5\times10^6$ and the wear ratio for Sample 4 was $3.5\times10^6$. These results are significant as the wear resistance of UHPHT PCD layer is 2.3 times as high as the wear resistance of the commercial cutter.

Figure 10A:
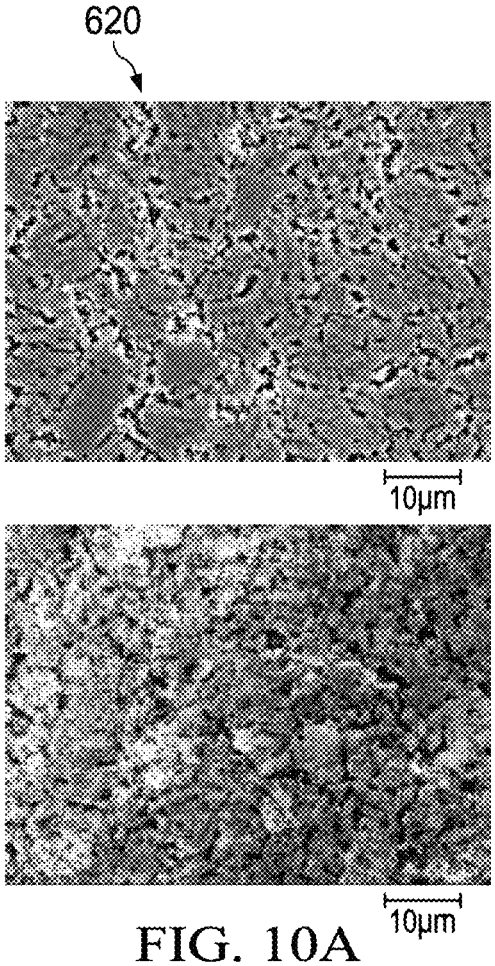
FIGS. 10A-10D are scanning electron microscope (SEM) photographs of the samples shown in FIGS. 7A-7D.
Figure 10B:
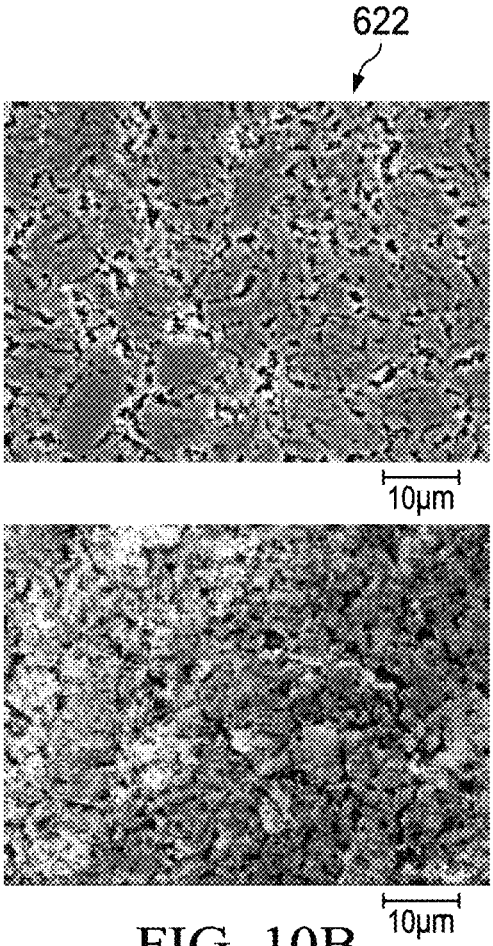
Figure 10C:
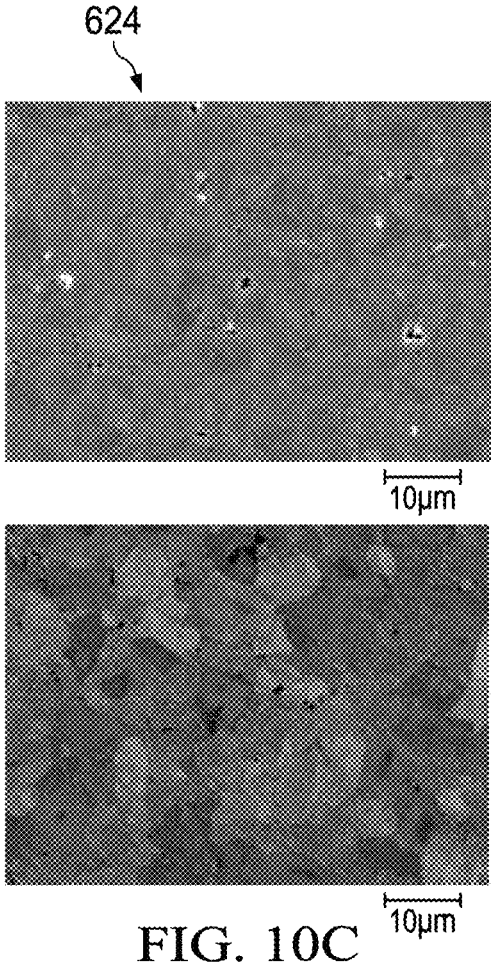
Figure 10D:
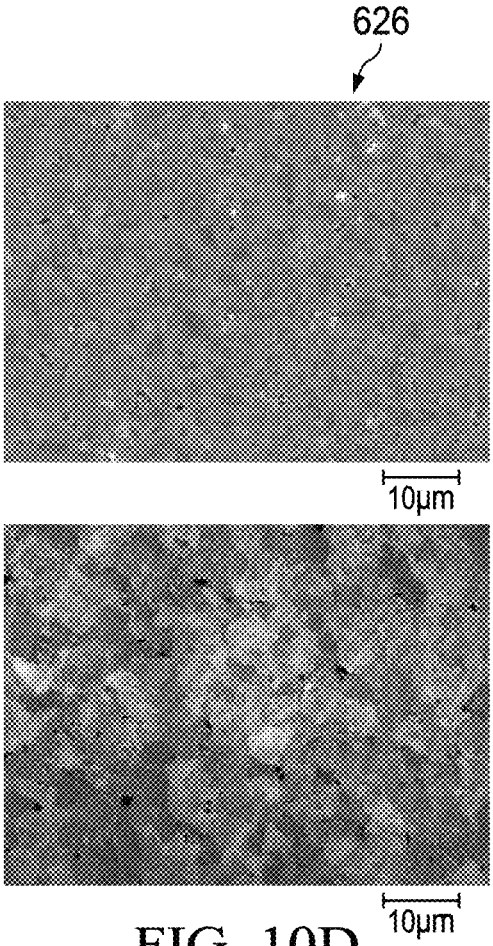

FIGS. 10A-10D are scanning electron microscope (SEM) images of multiple samples shown in FIGS. 7A-7D. In each figure, a SEM image of a side surface of the sample is displayed above a SEM mage of a top surface of the sample. FIG. 10A presents SEM images of the sample 620 as received and FIG. 10B presents SEM images of the sample 622 after grinding. It can be observed that the grain boundaries of Sample 2 (a side surface of the diamond layer after outer diameter grinding) are clearer than Sample 1 (a top surface of as received baseline sample). The grain size is about 10 μm and there are holes due to the acid treatment on the top surface of the as-received baseline samples for removal of cobalt. As compared with the commercial samples, the grains of Sample 3 and Sample 4 have a tight microstructure and the individual grains are relatively sharp and angular. The grain size of Sample 3 and Sample 4 is about 10 μm and 5 μm, respectively.

Figure 11A:
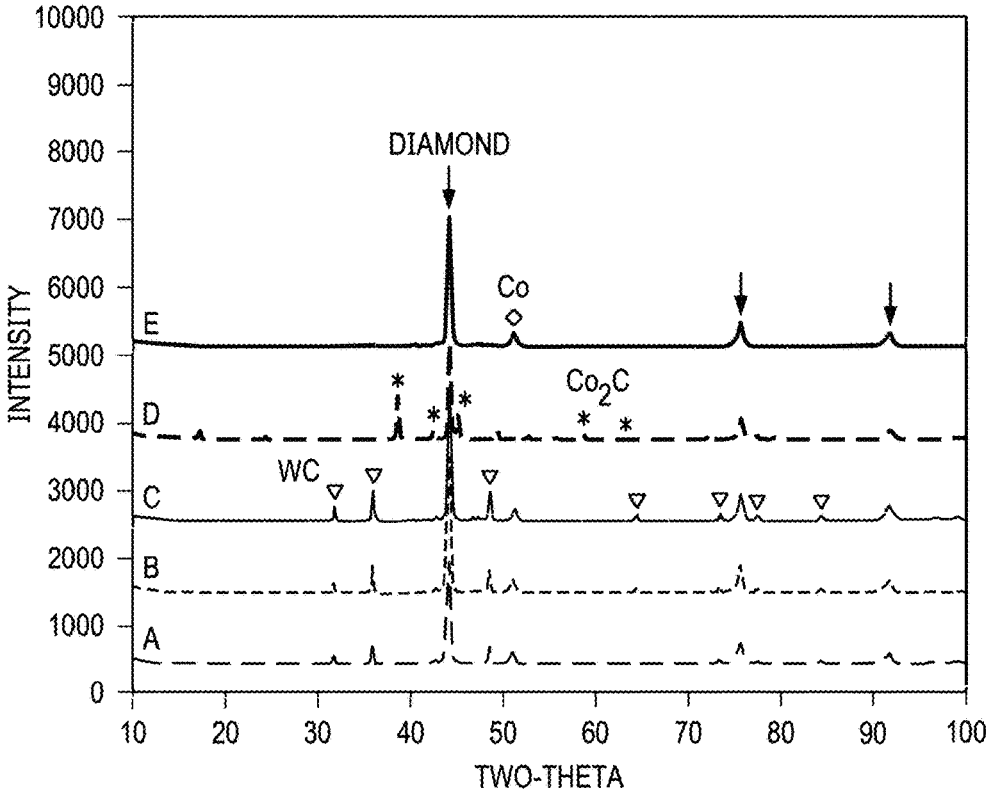
FIGS. 11A-11D are XRD of cutters at high temperatures.
Figure 11B:
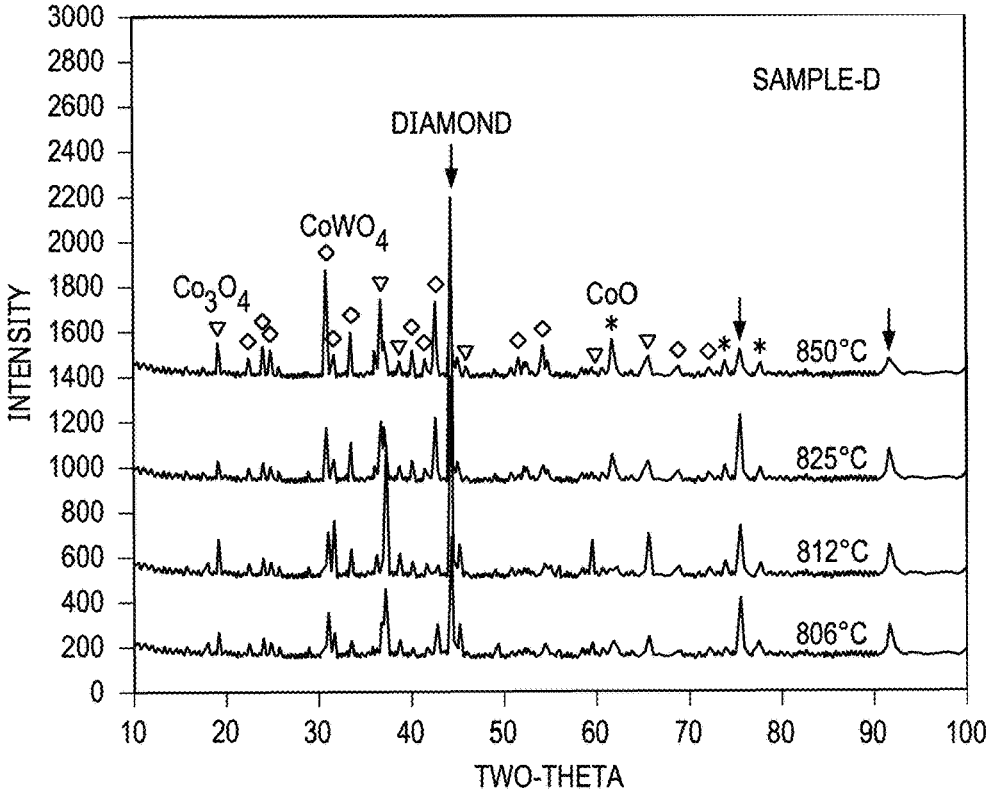
Figure 11C:
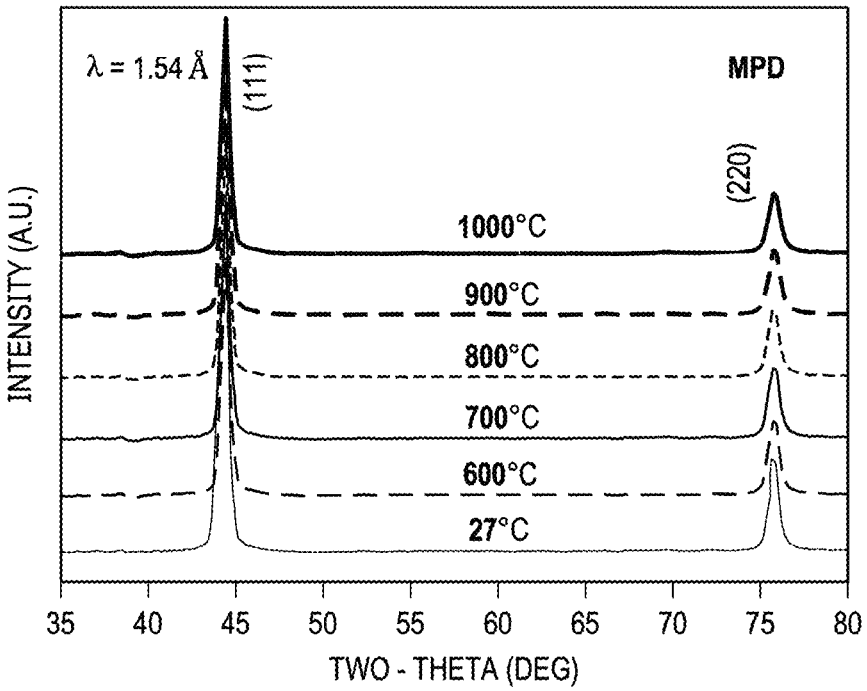
Figure 11D:
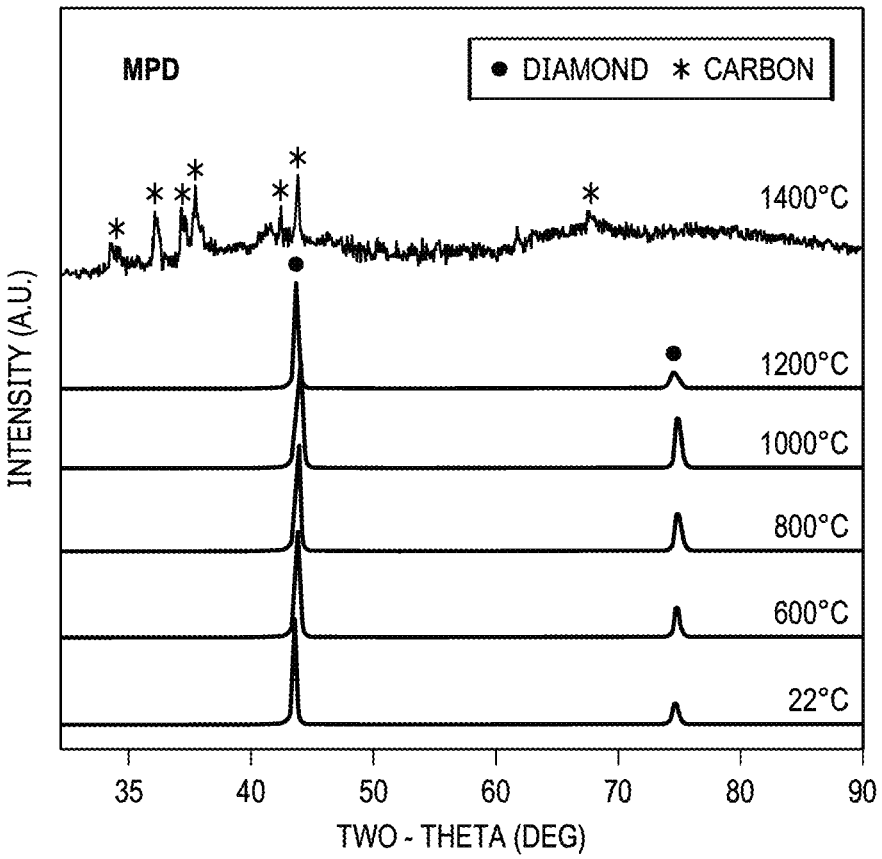

FIGS. 11A-11D are XRD of cutters at high temperatures performed to assess thermal stability of the cutters. FIGS. 11A and 11B are XRDs of the as-purchased commercial PDC cutters (FIG. 11A) and sample D (FIG. 11B) at various high temperatures. FIG. 11C is an XRD of the UHPHT 14-GPa cutting materials which shows these materials have good thermal stability at temperatures up to 1000° C. FIG. 11D is an in situ XRD of the UHPHT 16-GPa cutting materials which shows these materials have excellent thermal stability at temperatures up to 1400° C. The results indicated that the UHPHT 16-GPa cutting materials could keep stable over 1200° C. in the air, while the commercial PDC cutters usually start to get oxygenized at about 800° C.

Current PDC cutters range in size between 8 mm and 22 mm. For drilling applications, the minimum diameter of the ultra-strong PDC cutting material should be 8 mm. To form cutters, the synthesized UHPHT PCD material is joined to a substrate, such as a substrate formed from WC-Co. Various forming methods, including vacuum diffusion bonding, hot pressing, spark plasma sintering, microwave joining, or HPHT bonding technology may be used to joining the UHPHT PCD material to the substrate.

Conventionally, the substrate is pre-pressed and diamond is in powder form prior to forming PDC cutter by traditional High Pressure and High Temperature (HPHT) technology. In some of the approaches described below, the substrate is in the form of a powder when placed in contact with the PCD material. The pressures and temperatures experienced during the joining method can sinter the substrate material into a rigid material while also bonding the substrate to the UHPHT PCD material to form a PDC cutter, similar to the PDC cutter 102 shown in FIGS. 1 and FIGS. 2A and 2B. In some implementations, a starting material of the substrate may be a WC-Co powder having a Co content within a range of one percent to 20 percent by weight. The WC-Co powder may have a particle size within a range of 0.5 μm to 50 μm.

As mentioned above, cutters can be formed with a HPHT (conventional pressures ranging 5-7 GPa) bonding/joining technology using WC/Co powder while bonding to UHPHT catalyst-free PCD cutting materials or disks. Current UHPHT technology can also be applied to join PCD to the substrate in the form of a powder. For other proposed methods such as SPS and HP, we may use solid or pre-pressed WC substrate may be used instead of WC/Co powder to join or bond to the PCD materials. Besides HPHT and UHPHT joining methods, SPS methods may use the substrate in the form of a power due to using mold and its applying pressures higher to 1 GPa.

For vacuum bonding, the PCD material and substrate material are placed under a vacuum within a range of $10^{-2}$ Torr to $10^{-6}$ Torr, and exposed to bonding temperatures are within a range of 600° C. to 1200° C. Vacuum joining or brazing takes advantage of the "absence of air" in a hot zone environment where braze filler metals can be melted in a non-contaminating environment. In contrast to typical vacuum joining techniques, this approach includes a pressure is applied to the PCD material and substrate material. The applied pressure is in a range of 10 MPa to 1 GPa. These pressures overcome conventional low-vacuum joining bonding strength issues. A filler metal, such as niobium (Nb), molybdenum (Mo), titanium (Ti), or tungsten (W) may be included at an interface between the PCD material and the substrate material in order to promote bonding and to reduce joining temperatures.

Figure 12:
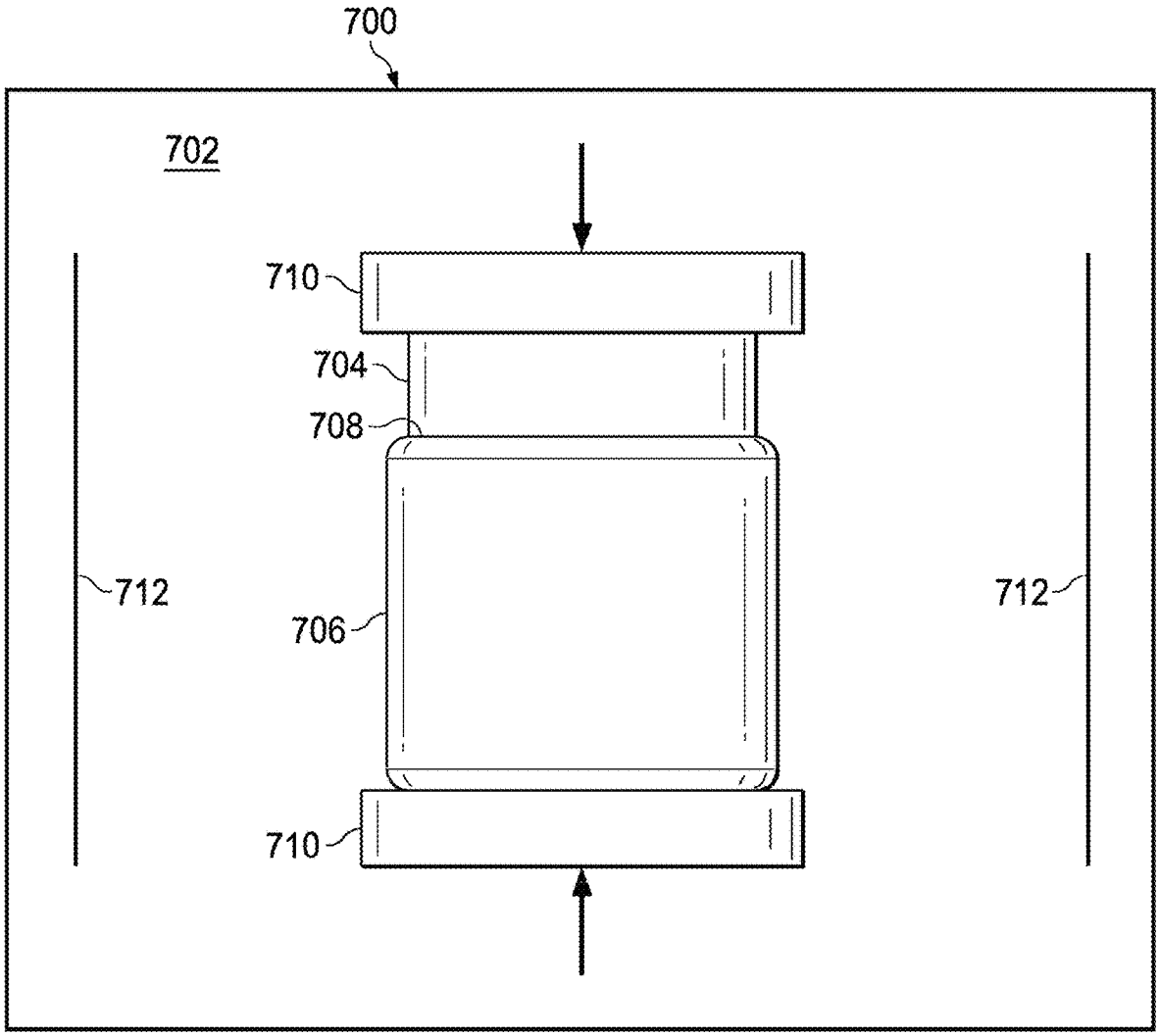
FIG. 12 is a schematic view showing an example vacuum diffusion bonding arrangement.

FIG. 12 is a schematic view showing an example vacuum diffusion bonding system 700 that can be used to form a cutter. The vacuum diffusion bonding system 700 includes a chamber 702 into which the PCD material 704 and substrate material 706 are placed. The PCD material 704 and substrate material 706 are stacked. The interface 708 between the PCD material 704 and substrate material 706 may be planar or nonplanar and may include a binder or omit a binder. Interface configurations are discussed in more detail with respect to FIGS. 14-16.

A binder in the form of a filler metal, such as niobium (Nb), molybdenum (Mo), titanium (Ti), or tungsten (W) may be placed between the PCD material 704 and substrate material 706. Within the chamber 702, the PCD material 704 and substrate material 706 are located between plates or pistons 710. The pistons 710 apply a load to the PCD material 704 and substrate material 706 in order to bond the two components together, forming a PDC cutter. As explained earlier, the substrate material 706 may be in the form of a powder prior to loading from the pistons 710. In some instances, the substrate material 706 may be in a compressed form when introduced into the chamber 702. The system 700 also includes a heater 712 to control a temperature within the chamber 702. The heater 712 may be an induction heater.

Vacuum joining takes advantage of the absence of air in a heated environment where filler metals are melted in a non-contaminating environment. As mentioned earlier, a metal filler may be disposed at the interface 708. The low pressure or vacuum atmosphere protects the PCD material 704, the substrate material 706, and any filler metals from atmospheric contaminants, particularly $O_2$ and $N_2$, while at high temperature, thereby preventing oxidation and nitriding. Avoiding this contamination improves material flow, material wetting, and adherence of the metal fillers to the PCD material 704 and the substrate material 706 to create a strong bond between the PCD material 704 and the substrate material 706. Because the new PCD material is catalyst and pinhole free inside the structure, vacuum can prevent diamond to graphite transition at high temperatures. In addition, the Co or other binders has a good wettability to the PCD material that is benefit to the metallurgical bonding.

Figure 13:
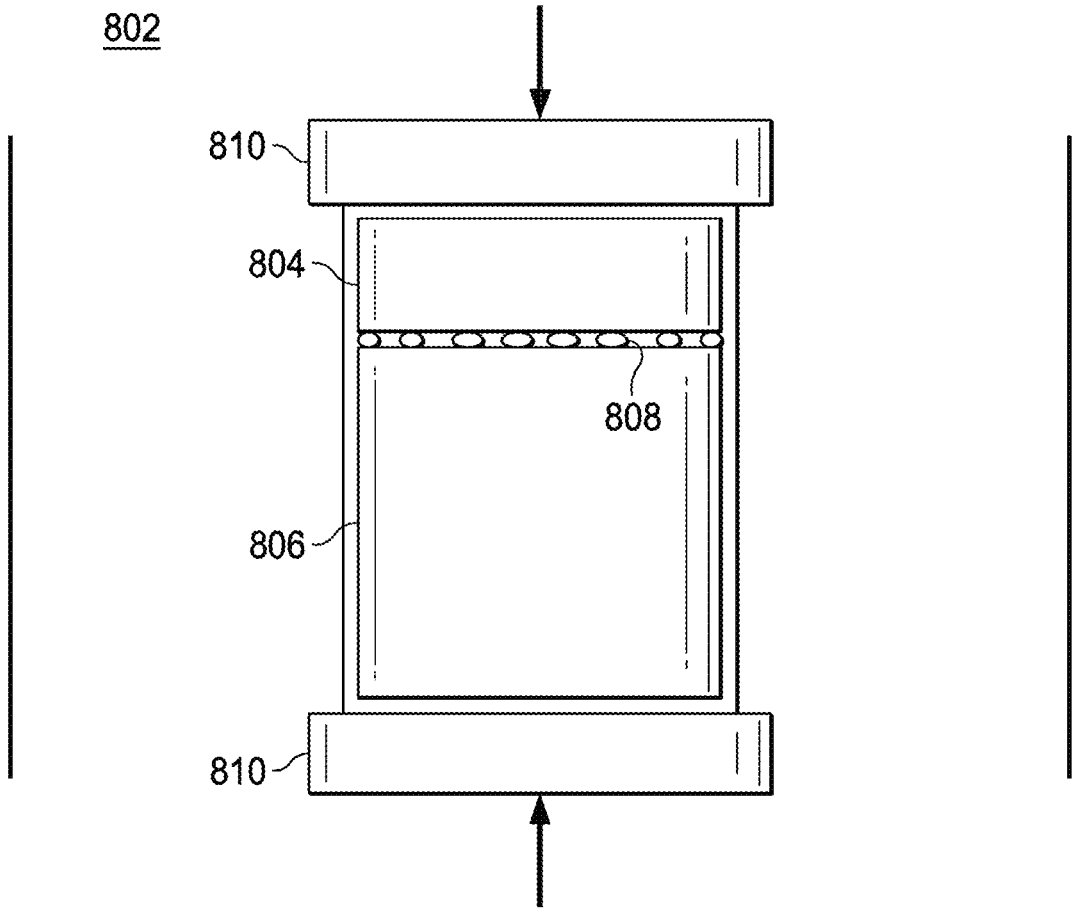
FIG. 13 is a schematic view of an example hot pressing arrangement.

FIG. 13 is a schematic view of an example hot pressing system 800. The hot pressing system 800 includes a chamber 802 into which a PCD material 804 and substrate material 806 are placed between pistons 810. The PCD material 804 and the substrate material 806 are stacked and define an interface 808. In some implementations, the pistons 810 are formed of graphite. In some implementations, the substrate material 806 may be in powdered form when introduced into the chamber 802. In other implementations, the substrate material 806 may be in a compressed form (i.e., already formed into a unitary solid) when introduced into the chamber 802. The pistons 810 apply a load to the PCD material 804 and substrate material 806 in order to bond the two components together and form a PDC cutter. A filler metal, such as niobium (Nb), molybdenum (Mo), titanium (Ti), or tungsten (W) may be included at the interface 808 between the PCD material and the substrate material in order to promote bonding and to reduce joining temperatures.

In operation, the chamber 802 is placed under a vacuum with a range of $10^{-2}$ Torr to $10^{-4}$ Torr, and the chamber 802 is heated to a temperature within a range of 600° C. to 1200° C. Additionally, an inert gas, such as argon (Ar), is introduced into the chamber 702 to prevent atmospheric contamination, such as from $O_2$ or $N_2$, as described earlier. In some implementations, loading applied by the pistons 810 may produce compressive pressures in the range of 10 MPa to 2 GPa.

Conventional hot pressing technologies are capable of generating a maximum compressive pressure of approximately 100 MPa. However, the present disclosure provides for pressures beyond 100 MPa, including pressures up to 2 GPa, with the use of pistons 810 formed from diamond or boron nitride (BN). The hot pressing is carried out under vacuum or inert atmosphere to prevent diamond oxidation and graphitization. It can also apply a pressure to the NPI interface to form better bonding strength.

Spark plasma sintering may also be used to join the PCD material, formed via a UHPHT process, to a substrate. Spark plasma sintering, also known as field assisted sintering or pulsed electric current sintering, involves a pulsed or unpulsed DC or AC current passed directly through a graphite die or piston used to compress the PCD material and substrate together. In some instances where the substrate is initially in the form of a powder, the piston is also used to compact the powder. In other implementations, the substrate may be compacted prior to spark plasma sintering. Joule heating (also known as resistive heating) is used to heat the PCD material and substrate. The pressure applied by the piston and increased temperature achieves a near theoretical density of the substrate at lower sintering temperatures compared to conventional sintering techniques. The heat generated is internal to the PCD and substrate, in contrast to conventional hot pressing, where heat is provided by an external heater. The internal heating can provide higher heating and cooling rates are possible with other sintering methods. As a consequence, sintering occurs more rapidly compared to other sintering methods.

In a trial operation, the PCD material and substrate material were heated to a temperature within a range of 600° C. to 1200° C. within at atmospheric pressure within a range of $10^{-2}$ Torr to $10^{-6}$ Torr, Temperature is increased by passing a pulsed or direct electric current of 1000 amps (A) to 2000 A through the PCD material and substrate material. The current may be applied using a voltage of approximately 10 volts (V). In some implementations, the PCD material and substrate material are heated in a stepwise fashion from ambient room temperature to a desired joining temperature. The low pressure atmosphere may be generated by application of a vacuum to a compartment containing the PCD material and substrate material.

The PCD material and substrate material may be heated at a rate of approximately 1000 K per minute. Heating at this rate reduces stress concentrations. Heating rates of between 10K per minute to 1000K per minute in the low pressure atmosphere described earlier are anticipated to provide the reduced stress concentrations. The rate at which the PCD material and substrate material are cooled may also be approximately 1000 K per minute. These heating and cooling rates reduce stress concentrations and increase bonding strength. Besides inert or vacuum atmosphere, SPS has faster heating rates than other methods to effectively avoid diamond degradation at high bonding temperatures.

Microwave joining may be used to join the PCD material formed via a UHPHT process to a substrate, whether initially in the form of a powder or a compacted material. Microwave energy is applied to the stacked PCD material and substrate material to heat these materials so as to bond the materials and form a PDC cutter for oil and gas drilling. In some implementations, microwave energy is applied to the PCD material and substrate material for 10 minutes, causing the PCD material and substrate material to reach 1200° C. Heating rates within a range of approximately 400° C. per minute to approximately 1000° C. per minute may be used to reduce the stress concentrations at an interface between the PCD material and substrate material as well as to enhance a bond strength between these materials. Microwaves can heat the materials internally, thus greatly shortening the bonding processing time at high temperature to prevent diamond degradation such as oxidization and graphitization.

HPHT sintering technology may also be used to join a PCD formed using a UHPHT process to a substrate material. In some implementations, a binder is included at an interface between the PCD material and the substrate material. In some implementations, the substrate may be in the form of a powder or in a compacted form. A pressure imparted to the PCD material and substrate material pressure includes pressures up to 8 GPa, and temperature applied may be within a range of approximately 1200° C. to approximately 1500° C. Where the substrate material is a powdered form of WC-Co, sintering temperatures can be reduced to approximately 1450° C.

Figure 14:
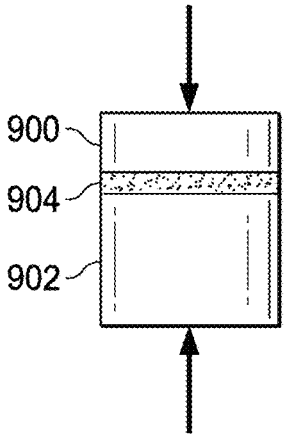
FIG. 14 is a schematic side view of an interface between a PCD material formed via a UHPHT process and a substrate

FIG. 14 is a schematic side view of a cutter with an interface between a PCD material formed via a UHPHT process and a substrate. The cutter has a planar interface 904 with a binder 906 disposed in the interface 904 to promote bonding of the PCD material 900 and the substrate 902. Some cutters are formed without a binder.

Figure 15A:
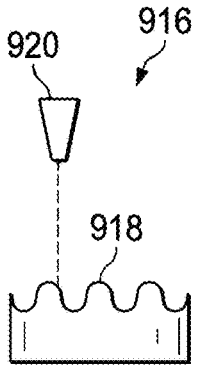
FIG. 15A is a schematic illustrating use of a laser to form a non-planar interface in PCD layer for a cutter.
Figure 15B:
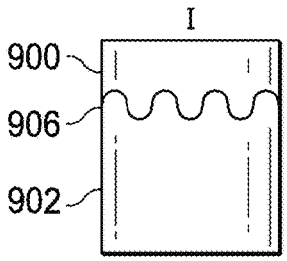
FIG. 15B is a schematic of the PCD layer formed by the process illustrated in FIG. 15A attached a substrate by mechanical locking of non-planar interfaces.
Figure 15C:
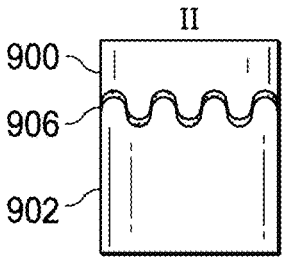
FIG. 15C is a schematic of the PCD layer formed by the process illustrated in FIG. 15A attached a substrate by mechanical locking of non-planar complemented by a binder.

FIG. 15A is a schematic illustrating use of a laser 920 to form a non-planar interface 906 between the PCD layer and the substrate for a cutter. The interface 906 is an undulating or sinusoidal interface. FIG. 15B is a schematic of the PCD layer 900 formed by the process illustrated in FIG. 15A attached a substrate 902 by mechanical locking of non-planar interfaces. FIG. 15C is a schematic of the PCD layer 900 formed by the process illustrated in FIG. 15A attached a substrate 902 by mechanical locking of non-planar complemented by a binder.

Figure 16:
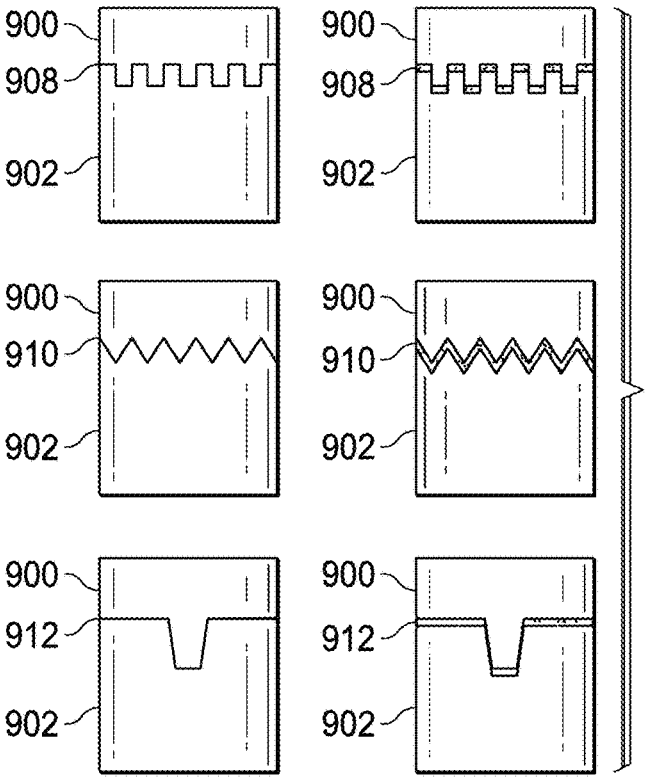
FIG. 16 is a schematic showing side views of various configurations of interfaces between PCD material formed via a UHPHT process and a substrate.

FIG. 16 is a schematic showing side views of various configurations of interfaces between PCD material formed via a UHPHT process and a substrate. As described earlier, a binder 906 may be disposed in the interface 904 to promote bonding of the PCD material 900 and the substrate 902. An interface 908 is an interface that resembles a square-wave; interface 910 forms a zig-zag or otherwise resembles a triangular wave; and interface 912 contains a single interlocking tooth 914. Column I shows these different interfaces without a binder disposed between the PCD material and the substrate, whereas Column II illustrates these different interfaces with a binder, such as a filler metal, disposed between the PCD material and the substrate.

Installing a PDC cutter into a drill bit is traditionally accomplished using a low-temperature brazing materials such as silver-based alloys. The brazing process for conventionally processed PDC cutters requires careful temperature control because damage to the PDC cutter can occur at temperatures exceeding 700° C., for example, with a cobalt catalyst the diamond can convert back into graphite at a temperature of 700° C. Silver-based brazing materials typically have melting temperatures between 650° C. and 710° C. Even with careful control, the temperature during the brazing of a conventionally processed PDC cutter into a drill bit can commonly exceed 750° C.

The catalyst free PDC cutters of the present disclosure can withstand temperatures up to 1400° C. without being damaged allowing a larger window of brazing temperatures. Using the traditionally silver-based alloys for brazing, the higher temperature damage threshold allows the cutter to be heated longer allowing better coverage of the brazing material resulting in better bonding. Further, the higher hear resistance enables a wider variety of high temperature brazing materials to be used, for example, copper-based alloys, nickel-based alloys, or titanium-based alloys. These high-temperature brazing materials provide better bonding strength as compared with silver-based alloys.

High-temperature brazing materials, such as titanium-based alloys, can also have higher wettability with the catalyst-free PCD diamond table. The higher wettability can allow brazing material to cover and bond to a portion of the PCD diamond table improving the bond strength between the PDC cutter and the body of the drill bit.

After the catalyst-free PDC cutters have been brazed into a drill bit, the body of the drill bit may need additional high-temperature treatments, particularly for steel-body drilling tools. The use of high temperature brazing materials increases the likelihood that neither the PDC cutter nor the brazing will be impaired by the heat treatment.

The better mechanical properties of the catalyst free PDC cutters, such as higher wear resistance, higher toughness, and higher impact resistance, can allow the use of these cutters in drilling systems and scenarios where implementing conventional PDC cutters could be cost prohibitive due to cutter failures and more frequent bit tripping. For example, a bottom hole assembly using a hydro-efflux hammer system experiences both shearing loads and dynamic percussive loads the combination of which could cause early failure of conventional PDC cutters; however, the increased mechanical properties of the catalyst free PDC cutters can withstand the higher loading.

Figure 17:
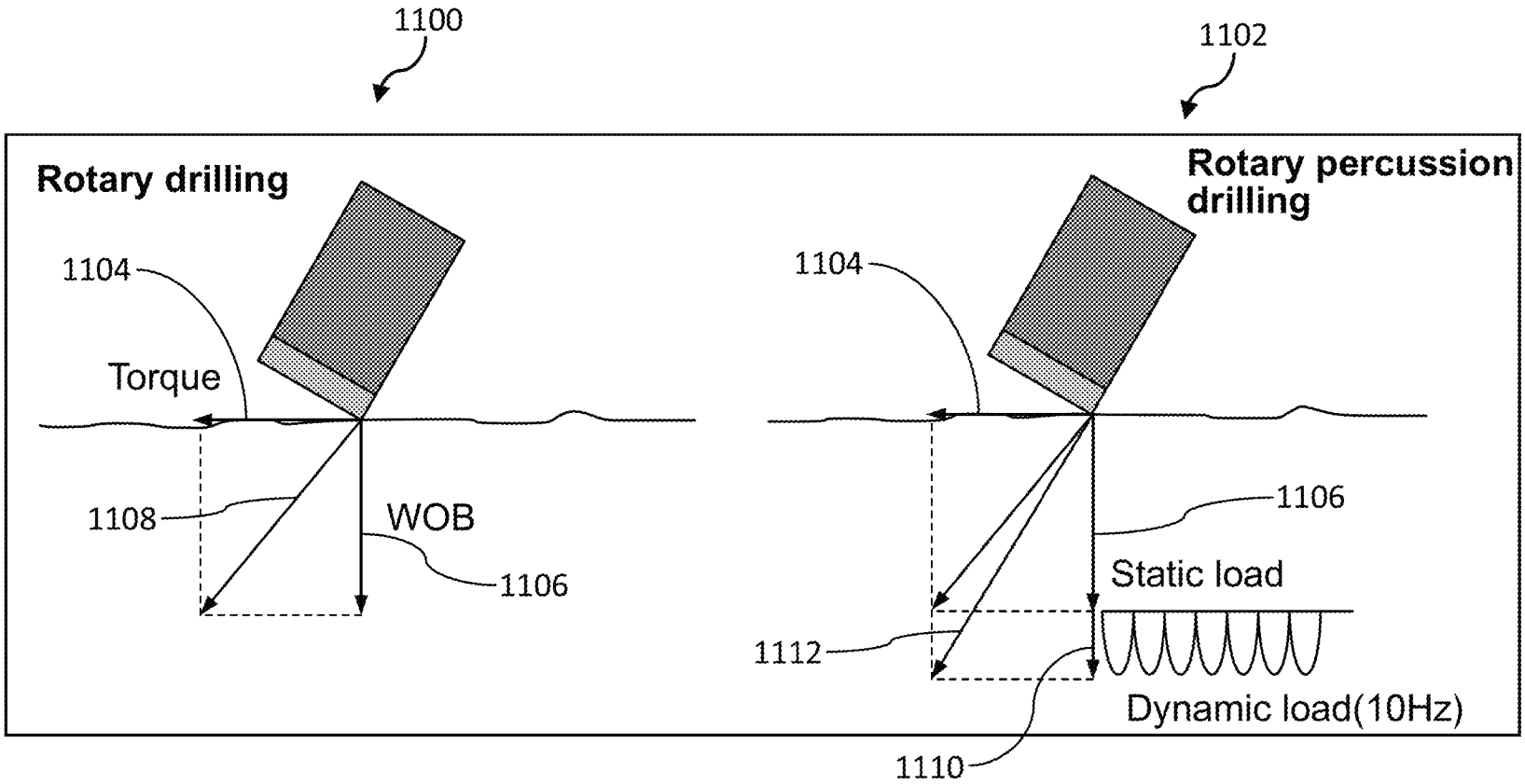
FIG. 17 shows loads on a PDC cutter during rotary drilling and during rotary percussion drilling.

FIG. 17 shows schematic views of example loadings experienced by a PDC cutter during rotary drilling 1100 and rotary percussion drilling 1102. In rotary drilling 1100, the PDC cutter experiences a normal force due to the weight on the bit (WOB) 1104 and shearing forces 1106 caused by the torque applied to the drill bit. The resultant force 1108 affects the rate of penetration (ROP) of the drill bit. In rotary percussion drilling, the PDC cutter can experience the same static normal force from the WOB 1104 and shearing force 1106 from the torque applied to the drill bit with the addition of a dynamic load 1110 from the percussive impact of the cutter. The dynamic forces can cycle at a predetermined frequency such as 10 Hz or 20 Hz. The resultant force 1112 on the PDC cutter in rotary percussion drilling has a larger component directed into the formation being cut, which can increase the ROP when compared with only rotary drilling. Increasing the ROP can increase the drilling efficiency. Rotary percussion drilling can be beneficial in hard and/or abrasive formations.

Figure 18:
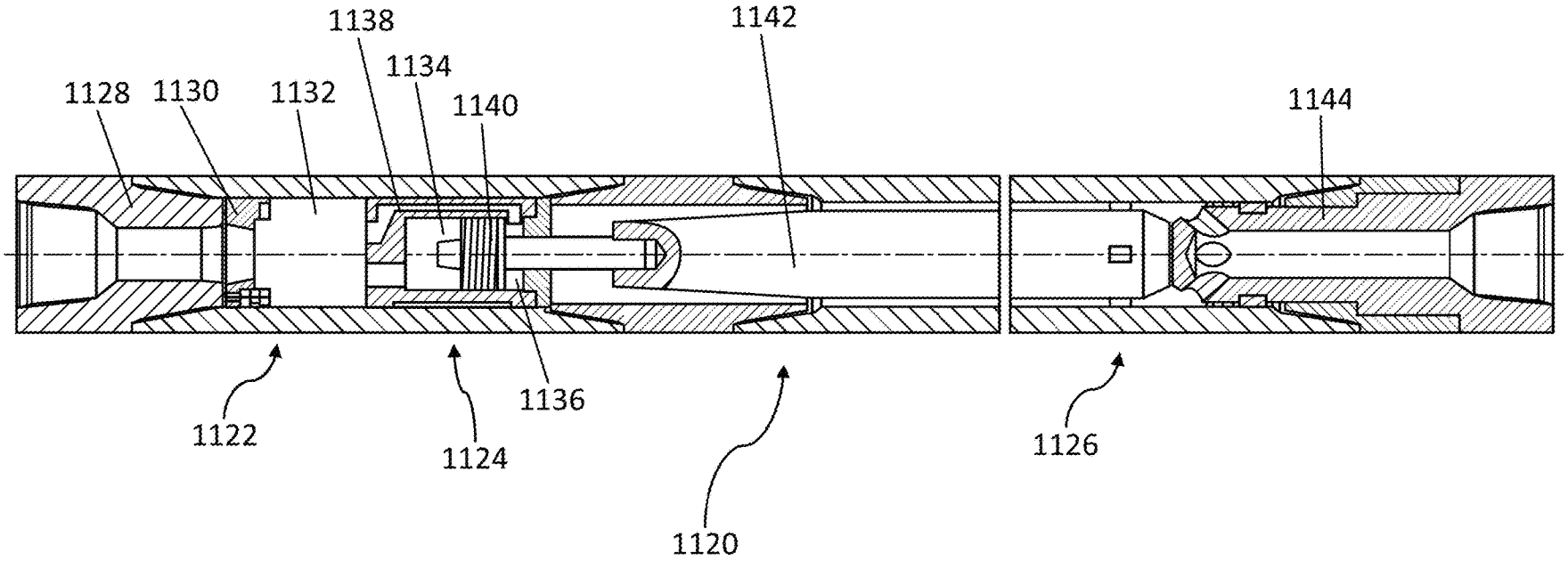
FIG. 18 shows a schematic of a hydro-efflux hammer system.

FIG. 18 shows a schematic view of a hydro-efflux hammer system 1120. A hydro-efflux hammer system 1120 can be included in a bottom hole assembly to generate an axial percussion energy in addition to the existing shearing energy when PDC cutters are engaged into the formation. It is installed in a drill assembly, between a lower part of a neutral point and the drill bit. The hydro-efflux hammer system 1120 comprises three major subsystems: a control unit 1122, a power unit 1124, and an energy transmission unit 1126. The upper joint 1128 connects the hydro-efflux hammer system 1120 to the lower part of the neutral point of the drill assembly. When in use drilling mud flows through the hydro-efflux hammer system 1120. A shunt device 1130 divides the drilling mud into two parts. One part of the drilling mud bypasses a jet element 1132 and the other part enters the jet element 1132. The jet element 1132 serves as a hydraulic control unit 1122. The jet element 1132 is designed based on the Coanda effect, a hydraulic effect that describes the tendency of a fluid jet to stay attached to a convex surface. As a result, the drilling mud produces a regulated commutation, flowing to an upper chamber 1134 and a lower chamber 1136 of a cylinder 1138 in an alternating fashion. The power unit 1124 comprises the cylinder 1136. The cylinder 1136 drives a piston 1140 through a reciprocating motion. The frequency of the reciprocating motion can be between 10 Hz and 20 Hz based on the properties and flow rate of the drilling mud. The piston 1140 is connected to a hammer 1142. The energy transmission unit 1126 comprises the hammer 1142 and an anvil 1144. The hammer 1142 reciprocates with the piston and delivers percussive energy to the anvil 1144. The impact energy generated from the hammer 1142 striking the anvil 1144 is transmitted to the drill bit and applied to the formation through the catalyst-free PDC cutters to enhance the drilling efficiency.

Figure 19:
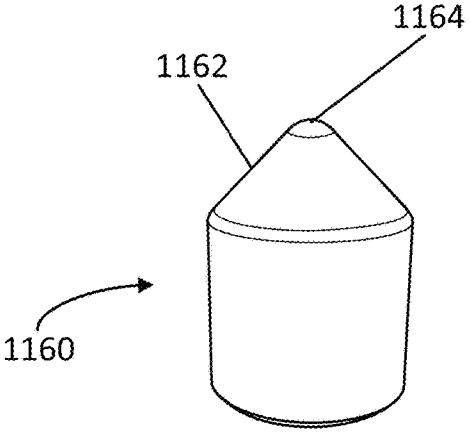
FIG. 19 shows an example of a conically shaped PDC cutter.

FIG. 19 shows an example of a PDC cutter 1160 with a conical end geometry 1162. Drilling efficiency can be enhanced by using a shaped PDC cutter. The shaped end of the PDC cutter can be formed directly during the formation of the diamond table of the catalyst free PDC cutter. To make such a geometry directly, the cavity 316 in the hydraulic cubic press can be pre-machined to match the desired shape of the catalyst free PDC cutter and to hold the raw material, such as diamond powder or graphite powder. In this process, the shaped end of the PDC cutter 1164 experiences a higher localized pressure, and therefore, it has better mechanical properties than other areas.

The PDC cutters can be formed by attaching a catalyst free synthesized PCD with a substrate such as tungsten carbide where the PCD is formed using the UHPHT systems and methods of the present disclosure. The PCD can be formed by applying a pressure of at least 14 GPa. Additionally, the catalyst-free synthesized PCD can be processed to a temperature of at least 1900° C. The PCD can have a diameter of at least 8 mm. The PCD can also have a diamond table thickness of at least 3 mm. The cutting end including the catalyst free synthesized PCD of the PDC cutter can have a planar, non-planar or shaped end. The shaped end can include symmetrical and asymmetrical geometries including a conical geometry.

Figure 20A:
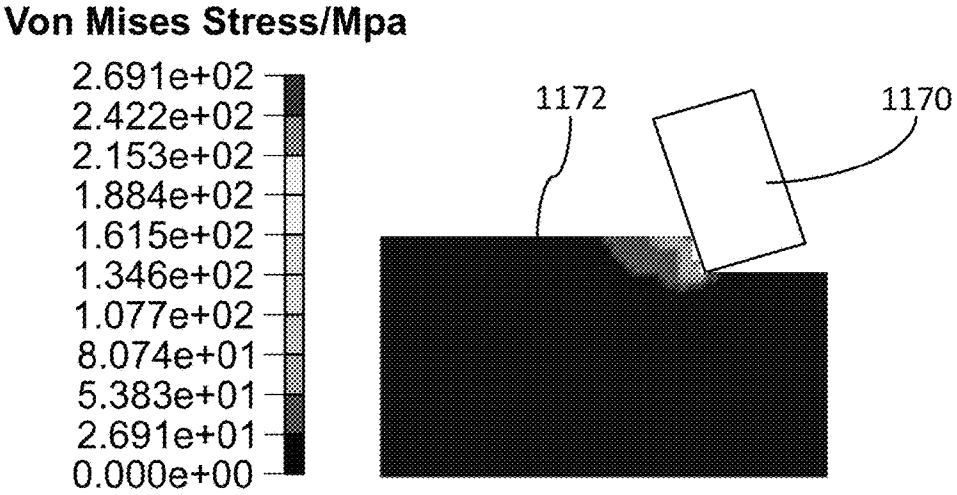
FIG. 20A-B show simulation results from catalyst-free PDC cutters interacting with a formation.

FIG. 20A shows a simulation of a cylindrical PDC cutter 1170 interacting with a formation 1172. In this example, the shearing forces are transmitted from the PDC cutter 1170 to the formation 1172. The stresses resulting from this interaction are localized near the surface of the formation.

Figure 20B:
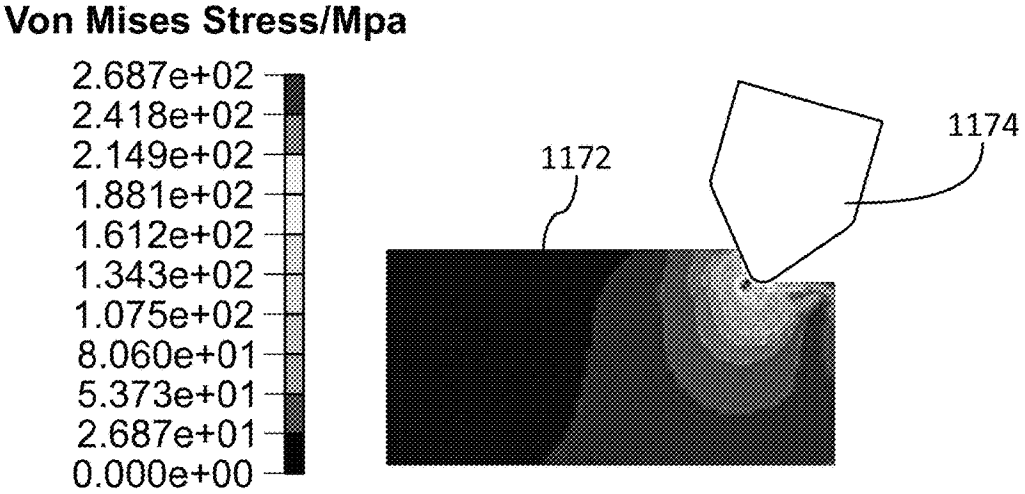

FIG. 20B shows a simulation of a conical PDC cutter 1174 interacting with a formation 1172. In this simulation, the stresses resulting from the interaction between the PDC cutter 1174 and the formation 1172 penetrate deeper into the formation 1172. With the stresses penetrating deeper into the formation, the formation can be easier to cut or break. A shaped PDC cutter such as a conically shaped PDC cutter 1160 can outperform traditional planar or flat PDC cutters. Shaped PDC cutters can also be used in drill bits included in bottom hole assemblies that also include percussive systems such as a hydro-efflux hammer system.

Figure 21:
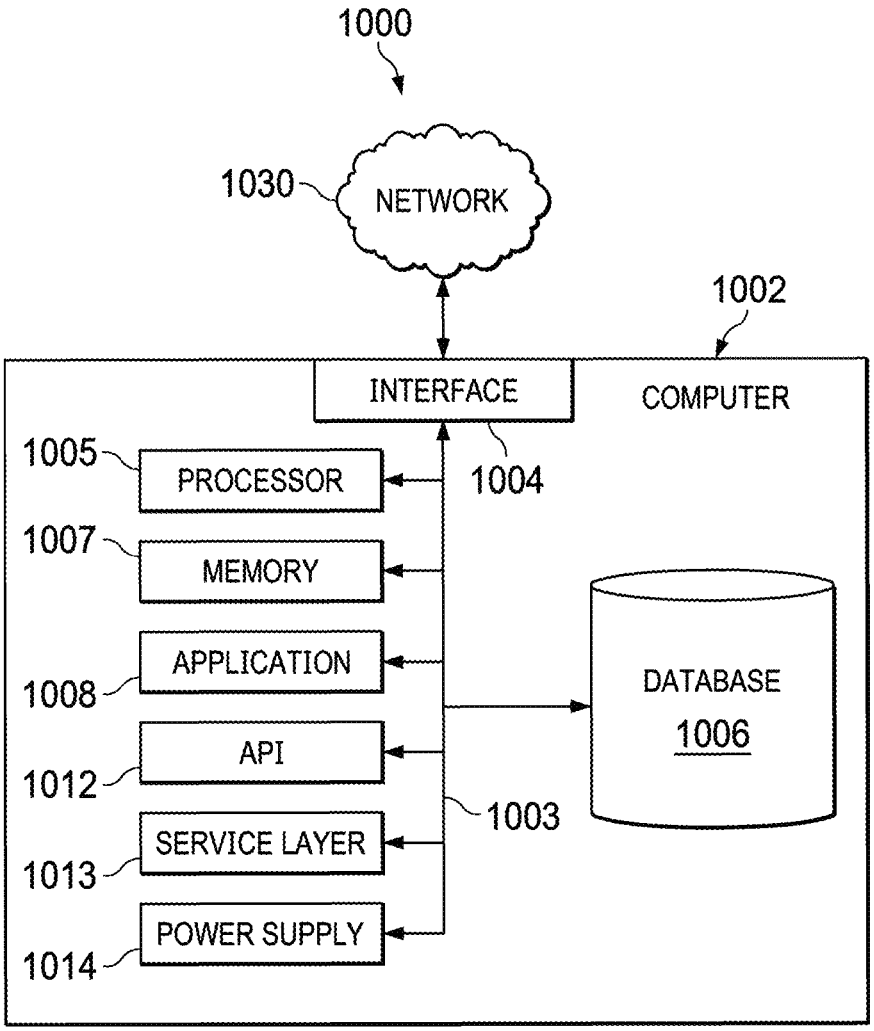
FIG. 21 is a block diagram illustrating an example computer system used to provide computational functionalities associated with described algorithms, methods, functions, processes, flows, and procedures as described in the present disclosure.

FIG. 21 is a block diagram of an example computer system 1000 used to provide computational functionalities associated with described algorithms, methods, functions, processes, flows, and procedures described in the present disclosure, according to some implementations of the present disclosure. The illustrated computer 1002 is intended to encompass any computing device such as a server, a desktop computer, a laptop/notebook computer, a wireless data port, a smart phone, a personal data assistant (PDA), a tablet computing device, or one or more processors within these devices, including physical instances, virtual instances, or both. The computer 1002 can include input devices such as keypads, keyboards, and touch screens that can accept user information. Also, the computer 1002 can include output devices that can convey information associated with the operation of the computer 1002. The information can include digital data, visual data, audio information, or a combination of information. The information can be presented in a graphical user interface (UI) (or GUI).

The computer 1002 can serve in a role as a client, a network component, a server, a database, a persistency, or components of a computer system for performing the subject matter described in the present disclosure. The illustrated computer 1002 is communicably coupled with a network 1030. In some implementations, one or more components of the computer 1002 can be configured to operate within different environments, including cloud-computing-based environments, local environments, global environments, and combinations of environments.

At a high level, the computer 1002 is an electronic computing device operable to receive, transmit, process, store, and manage data and information associated with the described subject matter. According to some implementations, the computer 1002 can also include, or be communicably coupled with, an application server, an email server, a web server, a caching server, a streaming data server, or a combination of servers.

The computer 1002 can receive requests over network 1030 from a client application (for example, executing on another computer 1002). The computer 1002 can respond to the received requests by processing the received requests using software applications. Requests can also be sent to the computer 1002 from internal users (for example, from a command console), external (or third) parties, automated applications, entities, individuals, systems, and computers.

Each of the components of the computer 1002 can communicate using a system bus 1003. In some implementations, any or all of the components of the computer 1002, including hardware or software components, can interface with each other or the interface 1004 (or a combination of both), over the system bus 1003. Interfaces can use an application programming interface (API) 1012, a service layer 1013, or a combination of the API 1012 and service layer 1013. The API 1012 can include specifications for routines, data structures, and object classes. The API 1012 can be either computer-language independent or dependent. The API 1012 can refer to a complete interface, a single function, or a set of APIs.

The service layer 1013 can provide software services to the computer 1002 and other components (whether illustrated or not) that are communicably coupled to the computer 1002. The functionality of the computer 1002 can be accessible for all service consumers using this service layer. Software services, such as those provided by the service layer 1013, can provide reusable, defined functionalities through a defined interface. For example, the interface can be software written in JAVA, C++, or a language providing data in extensible markup language (XML) format. While illustrated as an integrated component of the computer 1002, in alternative implementations, the API 1012 or the service layer 1013 can be stand-alone components in relation to other components of the computer 1002 and other components communicably coupled to the computer 1002. Moreover, any or all parts of the API 1012 or the service layer 1013 can be implemented as child or sub-modules of another software module, enterprise application, or hardware module without departing from the scope of the present disclosure.

The computer 1002 includes an interface 1004. Although illustrated as a single interface 1004 in FIG. 21, two or more interfaces 1004 can be used according to particular needs, desires, or particular implementations of the computer 1002 and the described functionality. The interface 1004 can be used by the computer 1002 for communicating with other systems that are connected to the network 1030 (whether illustrated or not) in a distributed environment. Generally, the interface 1004 can include, or be implemented using, logic encoded in software or hardware (or a combination of software and hardware) operable to communicate with the network 1030. More specifically, the interface 1004 can include software supporting one or more communication protocols associated with communications. As such, the network 1030 or the interface's hardware can be operable to communicate physical signals within and outside of the illustrated computer 1002.

The computer 1002 includes a processor 1005. Although illustrated as a single processor 1005 in FIG. 21, two or more processors 1005 can be used according to particular needs, desires, or particular implementations of the computer 1002 and the described functionality. Generally, the processor 1005 can execute instructions and can manipulate data to perform the operations of the computer 1002, including operations using algorithms, methods, functions, processes, flows, and procedures as described in the present disclosure.

The computer 1002 also includes a database 1006 that can hold data for the computer 1002 and other components connected to the network 1030 (whether illustrated or not). For example, database 1006 can be an in-memory, conventional, or a database storing data consistent with the present disclosure. In some implementations, database 1006 can be a combination of two or more different database types (for example, hybrid in-memory and conventional databases) according to particular needs, desires, or particular implementations of the computer 1002 and the described functionality. Although illustrated as a single database 1006 in FIG. 21, two or more databases (of the same, different, or combination of types) can be used according to particular needs, desires, or particular implementations of the computer 1002 and the described functionality. While database 1006 is illustrated as an internal component of the computer 1002, in alternative implementations, database 1006 can be external to the computer 1002.

The computer 1002 also includes a memory 1007 that can hold data for the computer 1002 or a combination of components connected to the network 1030 (whether illustrated or not). Memory 1007 can store any data consistent with the present disclosure. In some implementations, memory 1007 can be a combination of two or more different types of memory (for example, a combination of semiconductor and magnetic storage) according to particular needs, desires, or particular implementations of the computer 1002 and the described functionality. Although illustrated as a single memory 1007 in FIG. 21, two or more memories 1007 (of the same, different, or combination of types) can be used according to particular needs, desires, or particular implementations of the computer 1002 and the described functionality. While memory 1007 is illustrated as an internal component of the computer 1002, in alternative implementations, memory 1007 can be external to the computer 1002.

The application 1008 can be an algorithmic software engine providing functionality according to particular needs, desires, or particular implementations of the computer 1002 and the described functionality. For example, application 1008 can serve as one or more components, modules, or applications. Further, although illustrated as a single application 1008, the application 1008 can be implemented as multiple applications 1008 on the computer 1002. In addition, although illustrated as internal to the computer 1002, in alternative implementations, the application 1008 can be external to the computer 1002.

The computer 1002 can also include a power supply 1014. The power supply 1014 can include a rechargeable or non-rechargeable battery that can be configured to be either user- or non-user-replaceable. In some implementations, the power supply 1014 can include power-conversion and management circuits, including recharging, standby, and power management functionalities. In some implementations, the power-supply 1014 can include a power plug to allow the computer 1002 to be plugged into a wall socket or a power source to, for example, power the computer 1002 or recharge a rechargeable battery.

There can be any number of computers 1002 associated with, or external to, a computer system containing computer 1002, with each computer 1002 communicating over network 1030. Further, the terms "client," "user," and other appropriate terminology can be used interchangeably, as appropriate, without departing from the scope of the present disclosure. Moreover, the present disclosure contemplates that many users can use one computer 1002 and one user can use multiple computers 1002.

Implementations of the subject matter and the functional operations described in this specification can be implemented in digital electronic circuitry, in tangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as standalone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/nonvolatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback including, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of the present disclosure have been described. Nevertheless, it will be understood that various modifications may be made without departing from the spirit and scope of the present disclosure. Accordingly, other embodiments are within the scope of the following claims.

What is claimed is:

1. A method of forming a bottom hole assembly, the method comprising:

forming a plurality of catalyst-free synthesized polycrystalline diamonds from a diamond powder without leaching;

forming a plurality of cutters, each cutter comprising one of the plurality of catalyst-free synthesized polycrystalline diamond attached to a carbide substrate;

attaching the plurality of cutters to a body of a drill bit;

incorporating the drill bit with the attached cutters into a hydro-efflux hammer system.

2. The method of claim 1, wherein forming the plurality of the catalyst-free synthesized polycrystalline diamonds comprises applying a pressure of at least 14 GPa during processing of the catalyst-free synthesized polycrystalline diamond.

3. The method of claim 2, wherein the catalyst-free synthesized polycrystalline diamonds are processed to a temperature of at least 1900° C. during processing of the catalyst-free synthesized polycrystalline diamond.

4. The method of claim 3, wherein the catalyst-free synthesized polycrystalline diamonds have a diameter of at least 8 mm.

5. The method of claim 4, wherein the catalyst-free synthesized polycrystalline diamonds have a diamond table thickness of at least 3 mm.

6. The method of claim 5, wherein the catalyst-free synthesized polycrystalline diamonds have a planar end surface.

7. The method of claim 5, wherein the catalyst-free synthesized polycrystalline diamonds have a non-planar end surface.

8. The method of claim 7, wherein the catalyst-free synthesized polycrystalline diamonds have a conical end surface.

9. The method of claim 1, wherein forming a plurality of cutters comprises:

providing a substrate comprising tungsten carbide; and attaching the catalyst-free synthesized polycrystalline diamond to the substrate comprising tungsten carbide to form a PDC cutter.

* * * * *